US010512584B2

(12) United States Patent
Goodsell et al.

(10) Patent No.: US 10,512,584 B2
(45) Date of Patent: Dec. 24, 2019

(54) MOBILITY ASSISTANCE DEVICE

(71) Applicants: Kim Goodsell, Carlsbad, CA (US); Charles Benjamin Goodsell, Carlsbad, CA (US)

(72) Inventors: Kim Goodsell, Carlsbad, CA (US); Charles Benjamin Goodsell, Carlsbad, CA (US); Charles Stanley Curbbun, Encinitas, CA (US); Arvin Grande Abadilla, Encinitas, CA (US); Julian C. Groeli, San Diego, CA (US); Blake Chuanlun Wang, San Diego, CA (US); Jin Chen, Carlsbad, CA (US); Delbert Dale Johnson, San Diego, CA (US); William John Leach, San Diego, CA (US); Matthew Kranz, Encinitas, CA (US)

(73) Assignee: Rova Real Time, Inc., Carlsbad, CA (US)

( * ) Notice: Subject to any disclaimer, the term of this patent is extended or adjusted under 35 U.S.C. 154(b) by 350 days.

(21) Appl. No.: 15/122,617

(22) PCT Filed: Feb. 27, 2015

(86) PCT No.: PCT/US2015/017944
§ 371 (c)(1),
(2) Date: Aug. 30, 2016

(87) PCT Pub. No.: WO2015/134312
PCT Pub. Date: Sep. 11, 2015

(65) Prior Publication Data

US 2017/0071815 A1 Mar. 16, 2017

Related U.S. Application Data

(60) Provisional application No. 61/947,346, filed on Mar. 3, 2014.

(51) Int. Cl.
*A61H 3/04* (2006.01)
*A61H 3/00* (2006.01)

(52) U.S. Cl.
CPC ..... *A61H 3/04* (2013.01); *A61H 2003/004* (2013.01); *A61H 2003/006* (2013.01);
(Continued)

(58) Field of Classification Search
CPC ..... B62B 3/027; B62B 3/022; B62B 3/02
See application file for complete search history.

(56) References Cited

U.S. PATENT DOCUMENTS 2,212,053 A 8/1940 Smith
5,046,748 A 9/1991 Oat-Judge
(Continued)

FOREIGN PATENT DOCUMENTS

EP 2062559 A1 5/2009

OTHER PUBLICATIONS

International Preliminary Report of Patentability in International Patent Application No. PCT/US2015/017944, dated Aug. 3, 2016.
(Continued)

*Primary Examiner* — James A Shriver, II
*Assistant Examiner* — Vaughn Coolman
(74) *Attorney, Agent, or Firm* — Veros Legal Solutions LLP

(57) ABSTRACT

Devices and methods for mobility assistance are disclosed. The disclosed features may assist a person with movement by providing support for the person as the person moves. Further, features for easily storing and transporting items in various compartments of the device are disclosed. Support of the user and/or items may be provided by a lightweight composite structure that further allows for free movement of the user, such as taking full strides while walking or running. The device may further be repeatedly configured between
(Continued)

collapsed and deployed configurations via a locking mechanism and an actuatable release. Pivotable joints allow the various sections to be stowed into a smaller, collapsed configuration that is easily carried or otherwise transported, as well as deployed into a larger, deployed configuration for assistance while moving.

15 Claims, 8 Drawing Sheets

(52) U.S. Cl.
CPC ..... *A61H 2003/046* (2013.01); *A61H 2201/0161* (2013.01); *A61H 2201/0188* (2013.01); *A61H 2201/5048* (2013.01); *A61H 2201/5058* (2013.01)

(56) References Cited

U.S. PATENT DOCUMENTS 6,318,392 B1 11/2001 Chen
7,866,677 B1 1/2011 Rothstein et al.
8,157,286 B2 * 4/2012 Lai ..... B62B 7/08 280/639
8,469,388 B2 * 6/2013 Moore ..... B62B 9/245 280/642
8,500,143 B2 * 8/2013 Yu ..... A61H 3/04 180/19.3
9,393,983 B2 * 7/2016 Bost ..... B62B 7/004
9,687,411 B2 * 6/2017 Chen ..... A61H 3/04
9,714,045 B2 * 7/2017 Dhand ..... B62B 5/06
2005/0173878 A1 8/2005 Espejo
2005/0241889 A1 11/2005 Nebolon et al.
2007/0085302 A1 * 4/2007 You ..... B62B 7/06 280/642
2008/0296855 A1 * 12/2008 Roseman ..... B62B 3/027 280/33.993
2012/0013104 A1 * 1/2012 Geva ..... B62B 3/027 280/651
2013/0153616 A1 * 6/2013 Geva ..... B62B 3/02 224/401
2013/0257019 A1 * 10/2013 Eisinger ..... B62B 7/06 280/650
2014/0008946 A1 * 1/2014 Smith ..... B62B 7/08 297/183.1
2014/0069973 A1 * 3/2014 Peck ..... B60R 11/02 224/411
2014/0083476 A1 * 3/2014 Catton ..... A61H 3/04 135/67
2014/0110920 A1 * 4/2014 Ponticelli ..... B62B 5/087 280/651
2014/0125037 A1 * 5/2014 Andersen ..... A61H 3/04 280/639
2014/0232078 A1 * 8/2014 Kirby ..... A61H 3/04 280/47.35
2014/0232088 A1 * 8/2014 Ektron ..... B62B 7/12 280/648

OTHER PUBLICATIONS

International Search Report and Written Opinion in International Patent Application No. PCT/US2015/017944, dated Jun. 9, 2015.

* cited by examiner

MOBILITY ASSISTANCE DEVICE

INCORPORATION BY REFERENCE TO ANY PRIORITY APPLICATIONS

Any and all priority claims identified in the Application Data Sheet, or any correction thereto, are hereby incorporated by reference under 37 CFR 1.57. This application is a U.S. National Phase Application of PCT International Application No. PCT/US2015/017944, entitled "MOBILITY ASSISTANCE DEVICE" and filed on Feb. 2, 2015, which claims priority to U.S. Provisional Application No. 61/947,346, entitled "MOBILITY ASSISTANCE DEVICE" and filed on Mar. 3, 2014. Each of the aforementioned applications is incorporated by reference herein in its entirety, and each is hereby expressly made a part of this specification.

BACKGROUND

This disclosure relates generally to mobility assistance. In particular, features for providing a person physical support while walking, running or otherwise moving around are disclosed.

Many people require assistance with moving around. For an aging and/or disabled population, assistance with getting around is critical. Many people thus desire the independence afforded by devices to assist with movement. Many further desire mobility assistance devices that are practical and easy to use as well as transport.

Conventional approaches to assisting people with walking, jogging, running, or otherwise moving on one's feet have included impractical, complex and/or inconvenient structures. Some devices require the user to hold a handle with each hand with elbows at the user's side, which does not allow the user to rest weight on their elbows or forearms. Some approaches provide a user support but without ease and breadth of use. For instance, rigid structure walkers require burdensome lifting to use and do not provide for easy transport of other items while one uses the device. These conventional systems further create difficulty with transport of the devices by not easily or conveniently being transportable when not being used. For instance, wheelchairs require large spaces for storage and are cumbersome to lift and move. Typical approaches further limit the terrain one may move over. For instance, rollable devices do not provide a rugged frame and wheels for moving on unpaved surfaces. These systems also lack adequate choices for positioning of a user while providing support of user forces applied in a range of directions. For instance, conventional systems do not provide support at angles far from vertical. These drawbacks negatively impact one's independence when one is using such devices.

Therefore, a device that provides assistance with movement that is practical as well as easy to use and transport is desirable.

SUMMARY

The embodiments disclosed herein each have several aspects, no single one of which is solely responsible for the disclosure's desirable attributes. Without limiting the scope of this disclosure, its more prominent features will now be briefly discussed. After considering this discussion, and particularly after reading the section entitled "Detailed Description of Certain Embodiments," one will understand how the features of the embodiments described herein provide advantages over existing mobility assistance devices and methods.

Several embodiments of a mobility assistance device are disclosed. In some embodiments, the mobility assistance device has a front, a back, a left, and a right. The device comprises an upper section comprising a substantially horizontal handle extending between a left and a right side of the upper section, wherein the handle is configured for an average size adult person to grasp the handle while standing upright with the person's arms extending forward with elbows at the person's sides. The handle is located at a height sufficient for the person to rest the person's forearms on the handle when the person's elbows are substantially below the person's shoulders and in front of the person's body. The device further comprises a horizontal pivot axis coupled to the upper section, a forward section coupled to the pivot axis, a rearward section coupled to the pivot axis, left and right front wheels coupled with the forward section, left and right rear wheels coupled with the rearward section, and a left pivot joint and a right pivot joint coupled with the pivot axis, with which left and right sides of the upper section, the forward section, and the rearward section of the device are respectively coupled, wherein the upper section, the forward section, and the rearward section are configured to pivot relative to each other at the left and right pivot joints.

In some embodiments, the upper section is a single molded or machined piece or multiple pieces rigidly connected.

In some embodiments, the rearward section comprises a left rearward section extending downwardly from the left pivot joint to the left rear wheel; and a right rearward section extending downwardly from the right pivot joint to the right rear wheel, wherein the device has a substantially unobstructed space between the left and right rearward sections and between the rear wheels such that the person's feet and legs can swing into the unobstructed space beyond at least a portion of the rear wheels while the person is ambulating behind the device.

In some embodiments, the mobility assistance device further comprises an upper basket configured below the handle, coupled with the upper section and pivot axis, and extending forward from the upper section.

In some embodiments, the upper section comprises left and right side rim portions rigidly coupled with the left and right sides, respectively, and a forward rim portion rigidly coupled with the left and right side rim portions and comprising a forward rim subportion substantially parallel to the pivot axis, wherein the upper basket is coupled with the left side, right side, and forward rim portions.

In some embodiments, the upper basket further comprises a plane configured to be substantially horizontal when the device is in the deployed configuration, a sidewall coupled with the plane and comprising a top edge, and a collapsible enclosure comprising an upper enclosure edge and a lower enclosure edge, wherein the lower enclosure edge is coupled with the top edge of the sidewall, wherein the upper enclosure edge is coupled with the left side, right side, and forward rim portions, and wherein the collapsible enclosure is configured to at least partially collapse when the device is in a folded configuration.

In some embodiments, the upper basket further comprises at least one projection configured underneath the plane and pivotally coupled with the pivot axis.

In some embodiments, the mobility assistance device further comprises a lower basket coupled with and extending forward from the forward section.

In some embodiments, the mobility assistance device further comprises an upper basket, wherein the lower basket partially receives the upper basket when the device is in a folded configuration.

In some embodiments, the forward section comprises left and right forward rim portions rigidly coupled with the left and right sides of the forward section, respectively, and a front portion rigidly coupled to the left and right forward rim portions and having a front rim subportion substantially parallel to the pivot axis, wherein the lower basket is coupled with the front portion, the left forward rim portion, and the right forward rim portion.

In some embodiments, the upper section, the forward section, and the rearward section are configured to pivot relative to each other between folded and deployed configurations.

In some embodiments, in the deployed configuration, the device is configured to be operated on a surface with the front and rear wheels on the surface while an operator grasps the handle and ambulates behind the device.

In some embodiments, in the folded configuration, the device is configured to be operated on a surface with the front wheels on the surface while an operator grasps the pivot axis.

In some embodiments, the mobility assistance device further comprises a release coupled with the pivot axis, and a locking mechanism coupled with the release, wherein deactivating the release causes the locking mechanism to oppose pivoting of the upper section, the forward section, and the rearward section relative to each other, and wherein activating the release causes the locking mechanism to not oppose pivoting of the upper section, the forward section, and the rearward section relative to each other, and wherein the release deactivates when the device is in folded and deployed configurations.

In some embodiments, the mobility assistance device further comprises an adjustable locking mechanism coupled with the pivot axis, wherein adjusting the locking mechanism adjusts a first, second and third pivot force between the pivot joints and the upper section, the forward section and the rearward section, respectively.

In some embodiments, the mobility assistance device further comprises brakes coupled with at least one of the wheels, and at least one brake actuator coupled with the handle and configured to actuate the brakes, wherein actuating the brakes opposes rotation of the at least one of the wheels with which the brakes are coupled.

In some embodiments, the handle comprises a rear elongated portion comprising a rear subportion substantially parallel to the pivot axis, and left and right rear ends rigidly coupled with the rear subportion and the left and right sides, respectively, of the upper section, left and right forward portions rigidly coupled with and extending forward from the left and right ends, respectively, of the rear elongated portion, and a forward elongated portion comprising a forward subportion substantially parallel to the pivot axis, and left and right forward ends rigidly coupled with the forward subportion and the left and right forward portions.

In some embodiments, the handle further comprises a mobile device cradle configured to receive a mobile device.

In some embodiments, the rearward section further comprises a kickplate extending in a rearward direction near at least one of the rear wheels and configured to facilitate rotating the device backwards by placing a foot on the kickplate and pulling in a rearward direction on the handle.

In some embodiments, the rear wheels are larger than the front wheels.

In some embodiments, the front wheels are configured to pivot about a vertical axis.

Several embodiments are also disclosed for a method of folding a mobility assistance device to a folded configuration. The device may comprise a horizontal pivot axis having left and right pivot joints, an upper section having a handle, a forward section having a lower basket, an upper basket having a collapsible enclosure, a rearward section, front wheels, rear wheels, a release and a locking mechanism, wherein the upper section, the forward section and the rearward section are coupled with the pivot joints, wherein the rearward section is rigidly coupled with the pivot axis, and wherein the upper section, the upper basket, and the forward section are pivotally coupled with the pivot axis. In some embodiments, the method comprises activating the release, wherein activating the release causes the locking mechanism to not oppose pivoting of the upper section, the upper basket, the forward section, and the rearward section relative to each other, pivoting the upper section, the forward section, and the rearward section toward each other, receiving at least part of the upper basket in the lower basket, and collapsing at least partially the collapsible enclosure of the upper basket.

In some embodiments, method further comprises deactivating the release when the device is in the folded configuration, wherein deactivating the release causes the locking mechanism to oppose pivoting of the upper section, the forward section, and the rearward section relative to each other.

In some embodiments, method further comprises operating the device in the folded configuration by grasping the pivot axis and rolling the device on the front wheels.

Several embodiments are also disclosed for a method of deploying a mobility assistance device to a deployed configuration. The device may comprise a horizontal pivot axis having left and right pivot joints, an upper section having a handle, a forward section having a lower basket, an upper basket having a collapsible enclosure, a rearward section, front wheels, rear wheels, a release and a locking mechanism, wherein the upper section, the forward section and the rearward section are coupled with the pivot joints, wherein the rearward section is rigidly coupled with the pivot axis, and wherein the upper section, the upper basket, and the forward section are pivotally coupled with the pivot axis. In some embodiments, the method comprises activating the release, wherein activating the release causes the locking mechanism to not oppose pivoting of the upper section, the upper basket, the forward section, and the rearward section relative to each other, pivoting the upper section, the forward section, and the rearward section away from each other, pivoting at least part of the upper basket from the lower basket, and decollapsing a collapsed portion of the collapsible enclosure of the upper basket.

In some embodiments, the method further comprises deactivating the release when the device is in the deployed configuration, wherein deactivating the release causes the locking mechanism to oppose pivoting of the upper section, the forward section, and the rearward section relative to each other.

In some embodiments, the method further comprises operating the device in the deployed configuration using the handle and rolling the device on the front and rear wheels.

BRIEF DESCRIPTION OF THE DRAWINGS

The foregoing and other features, aspects and advantages of the present invention will now be described with reference to the drawings of certain embodiments, which are intended to illustrate and not to limit the present invention.

DETAILED DESCRIPTION

Embodiments of the invention will now be described with reference to the accompanying figures, wherein like numerals refer to like elements throughout. The terminology used in the description presented herein is not intended to be interpreted in any limited or restrictive manner, simply because it is being utilized in conjunction with a detailed description of certain specific embodiments of the invention. Furthermore, embodiments of the invention may include several novel features, no single one of which is solely responsible for its desirable attributes or which is essential to practicing the invention described herein.

The present disclosure concerns features for a mobility assistance device and methods of deploying, collapsing and using the same. The disclosed device may assist a user with movement by providing support for the user's body as the user moves with the device. Further, features for easily storing and transporting items in various compartments of the device are disclosed. Support of the user and/or items may be provided by a lightweight composite structure that further allows for free movement of the user, such as taking full strides while walking or running. The device may further be repeatedly configured between collapsed and deployed configurations via a locking mechanism and an actuatable release. Pivotable joints allow various sections of the device to be folded up to form a smaller, collapsed configuration that is easily carried or otherwise transported, as well as deployed into a larger, deployed configuration for assistance while moving. The user can also rest their elbows or forearms on the device at various angles for support while walking or resting.

Figure 1A:
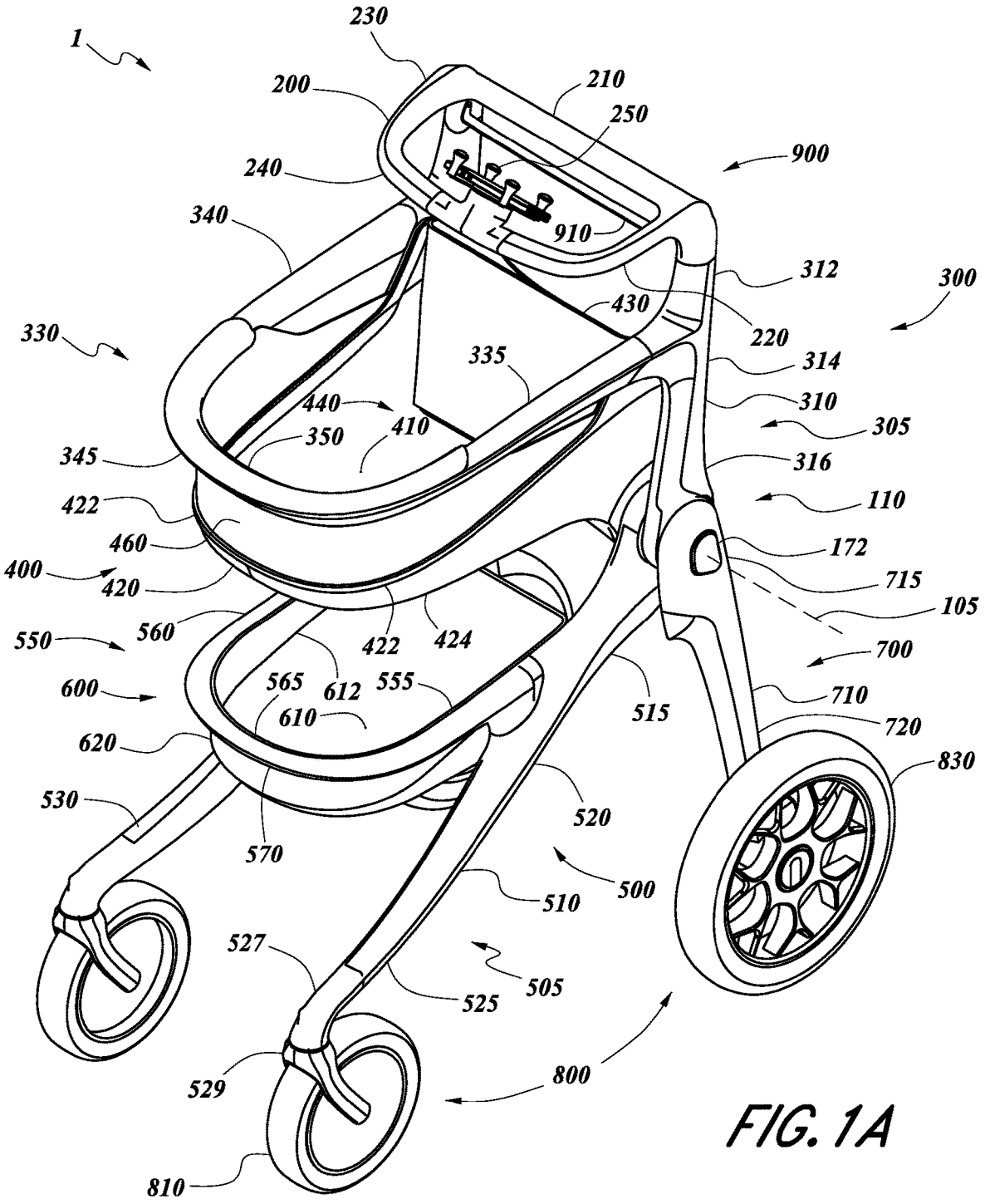
FIG. 1A is a perspective view of an embodiment of a mobility assistance device in a deployed configuration.

Referring now to FIG. 1A, a perspective view of an embodiment of a mobility assistance device 1 in a deployed configuration is shown. In the perspective view as oriented, the front, left and top sides of the device 1 are primarily shown. The device 1 as shown includes upper section 300 having a handle 200 on and an upper basket 400, a forward section 500 having a lower basket 600, and a rearward section 700. The upper section 300, the forward section 500 and the rearward section 700 couple to a pivot axis 100 (not visible in FIG. 1) near the rear of the device 1.

The device 1 as shown in FIG. 1A is in a deployed configuration. This is the configuration in which the device 1 may be used for support while moving. Some parts of the device 1 may be pivoted or rotated or otherwise moved to transform the device 1 into a different configuration. In some embodiments, the upper section 300, the forward section 500 and the rearward section 700 may each rotate toward each other and toward a collapsed configuration. In some embodiments, the various sections rotate about the pivot axis 100.

The pivot axis 100 may be a pivot member, such as an axle or rod. The axis 100 may be elongated such that it defines an axis of rotation 105. The various parts that are coupled to the axis 100 can pivot or otherwise rotate on the axis 100 about the axis of rotation 105. The axis 100 may be cylindrical with smooth outer surfaces or polygonal with sharp edges on the outer surface, or combinations thereof. The axis 100 may further be solid, hollow, or combinations thereof. Parts of the device 1 may couple to the axis 100 at a left pivot joint 110 and/or a right pivot joint 120 (not visible in FIG. 1). The pivot joints 110, 120 provide an attachment region of the axis 100 for the various parts to attach or otherwise couple to the axis 100. The pivot joints 110, 120 also provide regions of the axis 100 about which the various couple parts can pivot or rotate. The rotation of these various parts may be adjusted via a locking mechanism access 172. The access 172 is shown on the left side of the device 1 on the rearward section 700. The access 172 may instead or in addition be at other locations of the device 1, such as the rearward section 700 on the right side of the device 1.

One of the parts coupled to the axis 100 is an upper section 300 that includes a handle 200. The handle 200 is on the top of the upper section 300. The handle 200 as shown has an elongated rear portion 210, a left forward portion 220, a right forward portion 230 and a forward elongated portion 240. These portions may form a four-sided rim in the handle 200. The rear portion 210 is located in the rearward most position of the handle 200. The rear portion 210 is coupled at either end to the left forward portion 220 and to the right forward portion 230. These portions 220, 230 extend from the rear portion 210 in the forward direction and couple to either end of the forward portion 240.

Any of the various portions of the handle 200 may be grasped for assistance while moving. In some embodiments, the rear potion 210 is grasped with both hands by a user to provide support to the user. This support may be provided in a vertical or upward direction. The support may also be provided partially in a horizontal direction as well. In some embodiments, the forward portion 240 is grasped with the hands of a user for support. In this configuration, the rear portion 210 may be used to rest the user's forearms. Thus a user's forearms may be supported by the rear portion 210 while the forward portion 240 supports the hands. A user may further grasp or rest on or otherwise be supported by the left and right forward portions 220, 230. In one embodiment the user's forearms are resting on the rear portion 210 with left hand extending toward right elbow and vice versa, so that both the hands and forearms can be on the rear portion 210 at the same time, supporting the user in a very natural and comfortable position.

The handle 200 may further include a cradle 250. The cradle 250 may be used to store or hold items. The cradle 250 as shown is a mobile device cradle that can receive a mobile device, such as a cell phone, and hold it while the device 1 is used. As shown, the cradle 250 has four pegs that allow a user to easily place a mobile device in the cradle 250 and easily remove it therefrom. In some embodiments, the cradle 250 is smaller or larger to accommodate different size items, such as a tablet computer, a navigation device, or any other desired object. The cradle 250 may therefore serve as a mount for these and other devices. In some embodiments, the device 1 may have other accessories. For example, the device 1 may have an IV pole, an arm cradle, a sensor kit, or others. The sensor kit may include audible and/or visual displays to provide feedback, alerts, notifications, etc. to a user of the device 1.

The device 1 also includes a brake system 900. The brake system 900 includes a brake actuator 910. As shown, the brake actuator 910 may be an elongated, structural member on the handle 200. The actuator 910 may be a shorter or longer member and may be of various shapes and configurations. As shown, the actuator 910 is an elongated bar underneath the rear portion 210 of the handle 200. The actuator 910 may be moveably coupled with the handle 200. As shown, either end of the actuator 910 may be rotatably coupled to the handle 200. The actuator 910 may be depressed by pulling up on the bar and moving the bar towards the rear handle portion 210. Moving the actuator 910 will move mechanical linkages coupled to brakes on the wheels 800, as discussed in further detail herein, for example with respect to FIG. 1D. The further the actuator 910 is actuated, the more braking force is imparted to the wheels 800.

Under the handle 200, the upper section 300 includes one or more upper supports 305. The upper supports 305 provide support to the handle 200 and connect the upper section 300 to the axis 100. The upper supports 305 include a left side support 310 and a right side support 320 (right side not shown in FIG. 1). The left side support 310 extends from the handle 200 to the axis 100. As shown, the support 310 is coupled to the handle 200 at the intersection of the rear handle portion 210 and the left forward handle portion 220. The support 310 is shown rigidly attached to the handle 200, however other configurations are contemplated. For instance, the handle 200 may be moveably attached to the supports 305 such that the handle 200 may move relative to the supports 305. In some embodiments, the handle 200 may be rotated, extended, or otherwise adjusted relative to the supports 305. In some embodiments, the handle 200 may be extended upward or downward to accommodate users of different heights. In some embodiments, the handle 200 may be rotated at an angle for a more convenient support structure for a user. For instance, the handle 200 may be substantially horizontal in one configuration, and in another configuration it may be rotated about an axis parallel to the rotation axis 105, for an inclined or declined support.

The supports 305 include various portions or sections. The left side support 310 includes an upper end 312, a lower end 316, and a middle section 314 in between the two ends 312, 316. In some embodiments, the upper end 312 is coupled to the handle 200 and the lower end 316 is coupled to the axis 100 at a left pivot joint 110. The lower end 316 may be coupled with the axis 100 in between other parts that are also coupled to the axis 100 at the left pivot joint 110. The lower end 316 may include a slot or opening by which the lower end 316 couples with the axis 100. In some embodiments, the lower end 316 defines a cylindrical opening which mate with the axis 100 and/or pivot joint 110. Other shapes may be implemented to complement the various mating structures. Further, similar features and capabilities apply to the right side support 320, which has an upper end 322, a middle section 324, and a lower end 326. (The right side support 320 is not visible in FIG. 1).

The middle sections 314, 324 of the side supports 310, 320 are coupled to an upper rim 330. The upper rim 330 of upper section 300 includes a left side rim portion 335, a right side rim portion 340, and a forward rim portion 345. The left side rim portion 335 is coupled to the left side support 310 and the right side rim portion 340 is coupled to the right side support 320 at the respective middle sections of the supports. As shown, the portions 335, 340 are rigidly attached to the supports. In some embodiments, the portions 335, 340 are flexibly attached to the supports and may flex or otherwise by moveable.

The left and right side rim portions 335, 340 extend forward from the upper supports 305. The side rim portions 335, 340 may be horizontal or at an angle to the horizon. Further, the side rim portions 335, 340 may be at a right angle to the left and right side supports 310, 320, or they may be angled with respect thereto. The forward ends of the left and right side rim portions 335, 340 are coupled to the forward rim portion 345. The interfaces of the forward rim portion 345 with the side rim portions 335, 340 may be rounded, as shown, or they may be sharper corners. The forward rim portion 345 is the forward-most portion of the upper rim 330 and comprises a forward rim subportion 350. The subportion is located near the middle of the forward rim portion 345. The subportion 350 may be straight or curved or combinations thereof. In some embodiments, the subportion 350 is horizontal and/or substantially parallel with the axis of rotation 105 defined by the axis 100. The upper rim 300 may be horizontal, skewed, angled, or combinations thereof. As shown, the upper rim 330 is substantially horizontal. In some embodiments, the upper rim 330 is slanting downward or upward from the rear to the front.

A continuous structure of the upper section 300 may be formed by the upper rim 330, the upper supports 305, and the handle 200. In some embodiments, some or all of these parts of the upper section 300 are a single monolithic piece. In some embodiments, they are each monolithic parts that are then joined together to form a single piece. In some embodiments, the upper rim 330, the upper supports 305, and the handle 200 are made of composite material, such as fiber-reinforced plastics or polymers. These may be materials with a plastic or polymer matrix, such as epoxy, vinylester, polyester thermosetting plastic, or phenol formaldehyde resins. The matrix may be reinforced by various fibers, such as glass, carbon, basalt, or aramid. In some embodiments, the upper rim 330, the upper supports 305, and the handle 200 are molded together and made as a single, continuous, monolithic piece in the manufacturing process. The upper rim 330, the upper supports 305, and the handle 200 may also each be molded as separate composite parts and then joined or otherwise assembled together to form a single, continuous, monolithic piece. The couplings of the supports 310, 320 to the handle 200 and the upper rim 330 may be rigid couplings. As mentioned, they may be formed as a single piece or assembled together to form a single piece, and the interfaces of the various portions may be rigidly molded together. In some embodiments, the upper rim 330, the upper supports 305, and the handle 200 are fastened, adhered, bonded, or otherwise rigidly coupled together. In some embodiments, the upper rim 330, the upper supports 305, and the handle 200 are flexibly coupled together.

The upper section 300 may further include an upper basket 400. The various portions of the upper rim 330 may support the upper basket 400. The upper basket 400 is shown substantially underneath the upper rim 330.

The upper basket 400 includes an upper plane 410. The upper plane 410 is a floor or surface near the bottom of the basket 400. The plane 410 supports items that are placed into the basket 400.

The upper basket 400 further includes a sidewall 420. The sidewall 420 runs along various sides of the basket 400 and provides a vertical barrier to prevent items from falling out of the basket 400. The sidewall 420 runs along a left side of the basket 400, around the front side, and then along the right side. The height of the sidewall 420 is variable. The sidewall 420 tapers from a taller height near the rear of the basket 400 to a shorter height near the front. Other configurations of the sidewall are contemplated, such as a uniform height around the basket 400, etc.

The upper basket 400 further includes an enclosure 460. The enclosure 460 is a partially collapsible or foldable structure that allows the basket 400 to partially collapse to a smaller size. The enclosure 460 is coupled along the bottom to the sidewall 420. Along the top, the enclosure 460 is coupled to the upper rim 330. A shown, the enclosure 460 includes a lip or curved structure near the top that slows the enclosure 460 to rest on the upper rim 330. In some embodiments, the enclosure 460 is removably attached to the upper rim 330, such as by Velcro, snapons, or by snap a fit between the enclosure 460 and the upper rim 330. The upper lip of the enclosure 460 may be a rigid material while the lower vertical portion of the enclosure 460 is a flexible material. The flexible material of the enclosure 460 is what allows it to collapse, for example by folding or otherwise shrinking. The enclosure 460 may be cloth, fabric, vinyl, plastic, polymer or any other flexible, collapsible material. It may further be made of materials that are rigid when elongated but become pliable and foldable when bent.

The upper basket 400 further includes a divider 430. The divider 430 is near the rear of the basket 400. It is a vertical or substantially vertical barrier. The divider 430 along with the sidewall 420 and enclosure 460 define a forward compartment 440 in the basket 400. The forward compartment 440 is a forward storage portion of the basket 400 that may be used to store various items, such as groceries, bags, personal items, etc. The divider 430 may be rigid or flexible material. In some embodiments, it is a polymer or plastic wall having a thickness. The divider 430 may couple to the basket 400 at the sidewall 420, for instance by fastening, bonding, etc. The divider 430 may also be an integral part of the basket 400, such as a continuation of the sidewall 420 surfaces. In some embodiments, the divider 430 is a front wall of another compartment in the basket 400, discussed in further detail, for example, with respect to FIG. 1C.

The upper section 300 may pivot or rotate about the axis of rotation 105. In some embodiments, the upper section 300 rotates relative to the forward section 500 and rearward section 700. The upper basket 400 may be rigidly attached to the rest of the upper section 300 such that the basket 400 rotates along with the rest of the upper section 300. In some embodiments, the basket 400 is pivotably coupled with the axis 100, as discussed in further detail herein, for example with respect to FIG. 1D. Thus, the basket 400 may be independently rotatable about the axis of rotation 115. In some embodiments, rotation of the basket 400 is partially independent and partially constrained by the upper rim 330. For instance, the upper rim 330 in a deployed configuration, as shown in FIG. 1A, may prevent the basket 400 from rotating downward. Once the upper rim 330 is rotated downward toward a collapsed configuration, then the basket 400 may also be downwardly rotatable. In some embodiments, because the enclosure 460 is collapsible, the basket 400 may be upwardly rotatable when the upper rim 330 is in the deployed configuration.

The device 1 further includes a forward section 500. In some embodiments, the forward section 500 includes one or more side supports 505. The side supports 505 may include a left side support 510 and a right side support 530 (not visible in FIG. 1A). Although not explicitly addressed, similar features and functionality as discussed with respect to the left side support 510 apply to the right side support 530. The side supports 505 are configured along the sides of the forward section 500. The supports 505 provide stability to the device 1. They provide lateral stability as well as forward stability. The angled configuration, where the supports 505 extend forward and down at an angle, assists with balance and support of the user of the device 1.

The left and right side supports 510, 530 include respectively upper ends 515, 535, midsections 520, 540, and lower ends 525 545. The upper ends 515, 535 are the portions near the top of the supports 510, 530. The upper ends 515, 535 respectively couple with the axis 100 at the left and right pivot joints 110, 120. Therefore, the upper ends 515, 535 provide rotatable connections with the other structures of the device 1. In some embodiments, the upper ends 515, 535 define a slot or opening by which the upper ends 515, 535 couple to the axis 100 and/or pivot joints 110, 120. The upper ends 515, 535 may provide a cylindrical opening to mate with the various structures of the joints 110, 120. Other shapes may be implemented as well.

Opposite the upper ends 515, 535, on the other end of the side supports 510, 530 are the lower ends 525, 545. The lower ends 525, 545 are respectively the portions of the supports 510, 530 near the bottom. The lower ends 525, 545 couple with knuckles 527, 547 and forks 529, 549. For instance, the knuckle 527 provides an attachment for a wheel structure, including the fork 529. The fork 529 is rotatably coupled with the knuckle 527 and with a wheel 810. Therefore, the fork 529 can rotate along a substantially vertical axis at the coupling with the knuckle 527, and the fork 529 can rotate along a substantially horizontal axis at the coupling with the wheel 810. Similar features and functionality apply to the knuckle 547 and fork 549 on the ride side support 530.

The midsections 520, 540 of the supports 510, 530 are in between the upper ends 515, 535 and lower ends 525, 545. In some embodiments, the midsections 520, 540 are coupled to a forward rim 550. The forward rim 550 extends forward from the side supports 505. The forward rim 550 includes a left forward rim portion 555 that couples with and extends from the left side support 510 and a right forward rim portion 560 that couples with and extends from the right side support 530. The forward rim portions 555, 560 may be rigidly attached to the side supports 505. The portions 555, 560 may form an angle with the side supports 505. In some embodiments, the portions 555, 560 are substantially horizontal when in the deployed configuration. The forward ends of the forward rim portions 555, 560 may couple with a front rim portion 565 that includes a front rim subportion 570. The front rim portion 565 may be an elongated, laterally-directed portion of the front of the rim 550. The subportion 570 may be a substantially straight section of the portion 565. In some embodiments, the ends of the front rim portion 565 that couple with the left and right side supports 510, 530 may be rounded while the subportion 570 is essentially straight.

The forward rim 550 may provide support for a lower basket 600. The lower basket 600 includes a lower plane 610 having a perimeter 612 (not visible in FIG. 1A). The lower plane 610 provides a support surface near the bottom of the basket 600 to provide support for items in the basket 600. The basket may further include a sidewall 620. The sidewall 620 may run along the perimeter 612 of the lower plane 610. In some embodiments, the sidewall 620 connects the lower plane 610 to the forward rim 550. The sidewall 620 further helps prevent items from falling out of the lower basket 600 by providing a lateral barrier along the outside of the lower basket 600. The lower plane 610 and/or sidewall 620 may be rigid materials. In some embodiments, the lower plane 610 and/or sidewall 620 are plastic, polymeric, metallic, or other suitable rigid materials or combinations thereof. The lower plane 610 and/or sidewall 620 may instead or in addition be flexible materials. In some embodiments, the lower plane 610 and/or sidewall 620 are cloth, fabric, plastic, vinyl, or other suitable flexible materials or combinations thereof.

A continuous structure of the forward section 500 may be formed by the forward rim 550 and the side supports 505. In some embodiments, some or all of these parts of the forward section 500 are a single monolithic piece. In some embodiments, they are each monolithic parts that are then joined together to form a single piece. In some embodiments, forward rim 550 and the side supports 505 are made of composite material, such as fiber-reinforced plastics or polymers. These may be materials with a plastic or polymer matrix, such as epoxy, vinylester, polyester thermosetting plastic, or phenol formaldehyde resins. The matrix may be reinforced by various fibers, such as glass, carbon, basalt, or aramid. In some embodiments, forward rim 550 and the side supports 505 are molded together and made as a single, continuous, monolithic piece in the manufacturing process. The forward rim 550 and the side supports 505 may also each be molded as separate composite parts and then joined or otherwise assembled together to form a single, continuous, monolithic piece. The couplings of the supports 505 to the forward rim 550 may be rigid couplings. As mentioned, they may be formed as a single piece or assembled together to form a single piece, and the interfaces of the various portions may be rigidly molded together. In some embodiments, the forward rim 550 and the side supports 505 are fastened, adhered, bonded, or otherwise rigidly coupled together. In some embodiments, the forward rim 550 and the side supports 505 are flexibly coupled together.

The device 1 further includes a rearward section 700. In some embodiments, the rearward section 700 includes a left rearward section 710 and a right rearward section 730 (not visible in FIG. 1A). The left section 710 runs along the left side of the device 1 and the right section 730 along the right side. The sections 710, 730 are upright and at an angle when in the deployed configuration. The sections 710, 730 provide rearward support for the device 1 and the user of the device 1. The rearward section 700 may include lights. For example, running lights may be on the rearward section, which may provide visibility, safety, recognition, etc. The lights may have a circuit path lighting with auto nighttime motion sensors to turn on the lights when darker lighting conditions are detected. Such lights may in addition or alternatively be on the forward section 500 and/or other sections of the device 1.

The left section 710 includes an upper end 715 and a lower end 720. Similarly, the right section 730 includes an upper end 735 and a lower end 740 (not visible in FIG. 1A). The upper ends 715, 735 are near the top of the sections 710, 730 and couple with the axis 100 respectively at the pivot joints 110, 120. In some embodiments, the sections 715, 735 are rigidly coupled with the axis 100 at the joints 110, 120. Thus, the sections 715, 735 may not rotate relative to the axis 100. However, even with rigid connections, the sections 715, 735 may still rotate relative to the other sections of the device, for instance relative to the forward section 500 and upper section 300. In some embodiments, the rearward sections 715, 735 may be pivotably coupled with the axis 100 such that the sections 715, 735 can pivot or rotate relative to the axis 100. The upper ends 715, 735 may therefore have a slot or opening by which the sections 715, 735 couple with the axis 100. In some embodiments, a cylindrical opening is defined in the upper ends 715, 735. Other shapes may be implemented to complement the shape of the axis 100 and/or pivot joints 110, 120.

The lower ends 720, 740 of the rearward sections 715, 735 couple with wheels 800. In some embodiments, the lower ends 720, 740 each couple with a rear wheel 830. The rear wheels 830 are rotatably or pivotably coupled with the lower ends 720, 740 such that the wheels can rotate at the lower ends 720, 740. The rear wheels 830 provide rear support to rearward sections 715, 735 and therefore to the device 1. The wheels 800 may be formed from a variety of materials. In some embodiments, the wheels 800 may be soft or pneumatic for smooth gliding and optional tread for different seasons and different terrains. The wheels 800 may be replaceable to accommodate various such scenarios, such as snow conditions, dry conditions, use in the home, use off-road, etc. The wheels 800 may include high tech rims for quick release and easy swap out.

The various sections of the device 1 may be sealed together at their respective interfaces and/or at interfaces within each of the sections. In some embodiments, these interfaces may be sealed to allow for easy spray-down and cleaning of the device 1. The sections may be sealed together or may have an extra sealing part in between the interface to achieve the seal. For example, the upper section 300 may be sealed at various interfaces with the forward section 500 and/or the rearward section 700. As another example, the various sections forming the pivot joint 110 may form a sealed pivot joint 110 that is impervious to liquids. These are merely some examples and other interfaces may be similarly sealed.

Figure 1B:
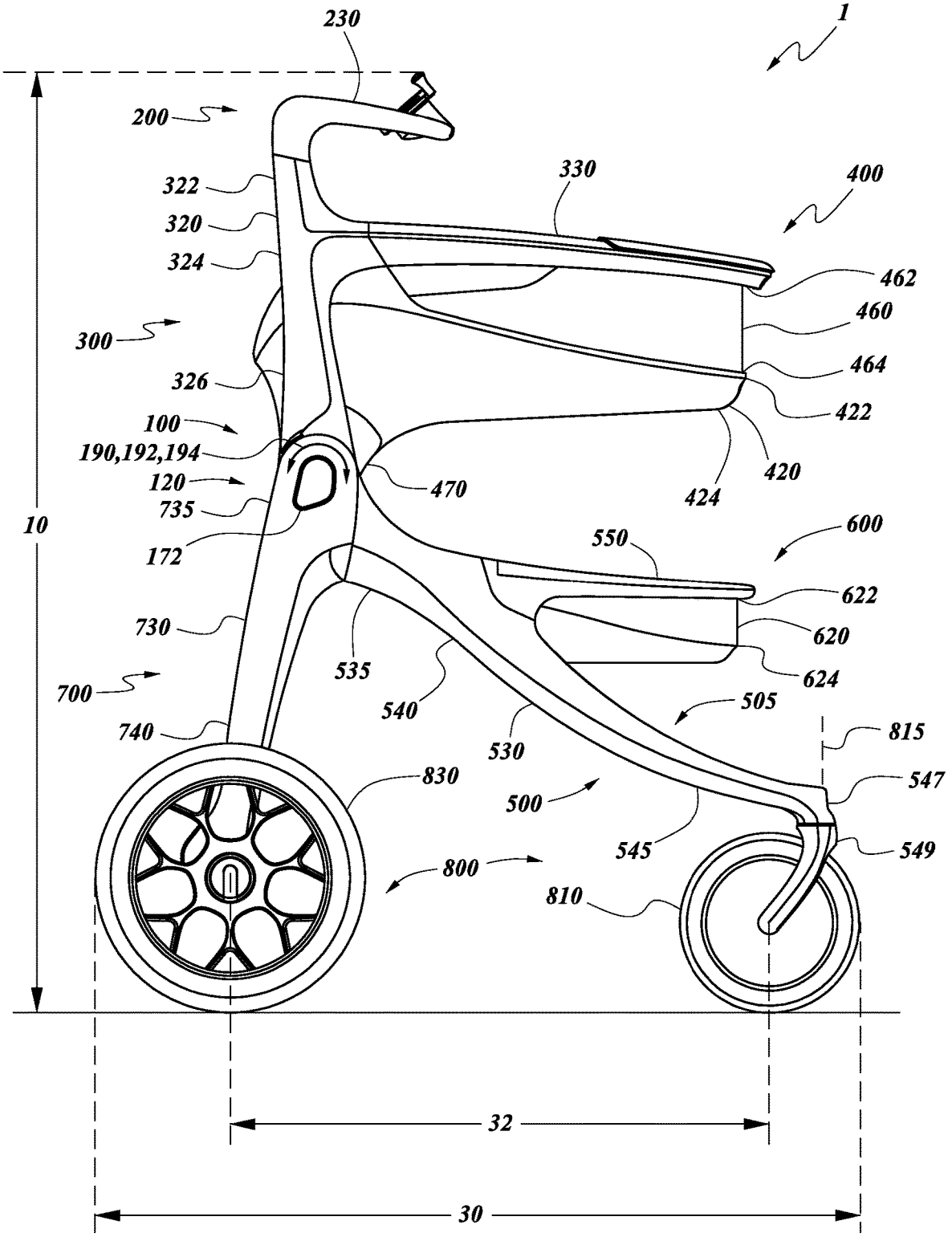
FIG. 1B is a side view of the device of FIG. 1A.

FIG. 1B is a side view of the right side of the device 1. The device 1 is shown in the deployed configuration where it may be used for support as a user moves with it from left to right, as oriented in FIG. 1B. The upper section 300 is shown including the handle 200, the upper basket 400, the forward section 500 with lower basket 600 and the rearward section 700 along with wheels 800.

The handle 200 is shown at the top of the device 1. The handle 200 extends forward at a slight decline from back to front. Thus, for example, the right forward section 230 is shown as slanting down and to the right. The rest of the handle 200 structure is not visible as it is lined up with the handle 200 structure that is visible. Therefore, the forward elongated portion 240 may be forward of and slightly below the rear elongated portion 210. The two portions 240, 210 may further be horizontal. In some embodiments, the forward elongated portion 240 may be even with or above the rear elongated portion 210. In some embodiments, the various portions of the handle 200 are moveable. For example, in some embodiments the handle 200 may be raised or lowered vertically or substantially vertically. In some embodiments the handle 200 may extend further forward or backward. In some embodiments, the angle of the handle 200 may be adjusted.

Further shown in FIG. 1B is the right side support 320 of the upper section 300. The support 320 includes an upper end 322, a lower end 326, and a middle 324 in between the two ends 322, 326. Underneath the right side support 320 is the right rearward section 730. The section 730 includes an upper end 735 and a lower end 740. The upper end 735 of the right rearward section 730 and the lower end 326 of the right side support 320 are coupled to the axis 100 (not visible in FIG. 1B). In some embodiments, the lower end 326 of the right side support 320 is coupled to the same right pivot joint 120 as the upper end 735 of the right rearward section 730. Thus, the right side support 320, the axis 100, and the right rearward section 730 may provide a line of action through which forces exerted on the handle 200 by a user are transmitted. Similar features and functionalities apply to opposite structures on the left side of the device 1.

Another line of action may be through the forward section 500. For instance, the right side support 530 couples to the axis 100 at an upper end 535. A lower end 545 couples to a front wheel 810 on the right side. Thus, another line of action may be from the handle 200, through the right side support 320, the axis 100, the right side support 530 and down through the wheel 810. As the forward section 500 is positioned forward of the handle 200, the section 500 provides stability to the device 1. As shown, the side supports 505 of the forward section 500 angle forward from the axis 100. Thus, forward and backward stability is provided to the structure of the device 1.

As mentioned, the upper basket 400 includes an enclosure 460 having an upper edge 462 and a lower edge 464. The upper edge 462 couples with the upper rim 330. The lower edge 464 couples with the top edge 422 of the sidewall 420. The portion of the enclosure 460 between the upper edge 462 and lower edge 464 may fold up or otherwise collapse. It is shown in FIG. 1B in the deployed configuration. The collapsed configuration is discussed in further detail herein, for example with respect to FIG. 2B.

The sidewall 420 includes a lower edge 424 as shown as well. The lower edge 424 may run along the underside of the basket 400. In some embodiments, the lower edge 424 is underneath the top edge 422.

The sidewall 620 of the lower basket 600 is also shown. The sidewall 620 includes an upper edge 622 and a lower edge 624. The upper edge 622 couples to the forward rim 550. The upper edge 622 may be fastened, adhered, bonded or otherwise attached to the forward rim 550. The lower edge 624 is coupled with the lower plane 610 (not visible) of the basket 600. The lower edge 624 may be fastened, adhered, bonded or otherwise attached to the lower plane 610.

As shown, the upper and lower baskets 400, 600 extend forward a similar amount. In some embodiments, one or the other may extend further forward. For instance, the lower basket 600 may extend further forward than the upper basket 400, or vice versa. The baskets 400, 600 may further be at various angles. As shown, both baskets 400, 600 are substantially horizontal or flat. In some embodiments, one or both baskets 400, 600 may be angled down, up, or combinations thereof.

Various sections may pivot or rotate about the axis of rotation 105 defined by the axis 100. Associated with these rotations may be rotational forces. For instance, a first rotational force 190 may be associated with rotation of the upper section 300 about the axis 100. The first rotational force 190 may be a frictional force opposing rotation of the upper section 300. Similarly, a second pivot force 192 and a third pivot force 194 may be associated respectively with the forward section 500 and the rearward section 700. The various forces may be adjusted so that it is easier or harder to rotate the various sections. In some embodiments, access to a locking mechanism 170 for adjusting such forces is provided by a locking mechanism access 172. The access 172 may be on the outside of the device 1 near the pivot joints 110, 120. For instance, as shown an access 172 is on the outside of the right pivot joint 120. The access 172 may be a cover, cap, tab, plate or other structure that may be removed to access the locking mechanism 170. The access 170 may snap fit, fasten, or otherwise mechanically attach to the right rearward section 730. As is discussed in further detail herein, the locking mechanism 170 may be accessed from the access 172 and adjusted to increase or decrease the rotational forces associated with rotation of the various rotating parts.

Further shown in FIG. 1B are some of the wheels 800. The right side forward wheel 810 and the right side rear wheel 830 are shown. Not visible are the left side forward wheel 810 and the left side rear wheel 830 on the opposite side of the device 1. The left and right forward wheels 810 can swivel to provide directional control of the device 1. The right forward wheel 810 can swivel about the forward wheel axis 815. In some embodiments, the knuckle 547 interfaces with the fork 549 at a rotatable interface. Thus the fork 549 may swivel with respect to the knuckle 547. The wheel 810 may be rigidly coupled with the fork 549 such that the wheel 810 and fork 549 rotate together. The axis 815 is substantially vertical, allowing the wheel 810 and fork 549 to turn the device 1 to the left and right. The left forward wheel 810 and fork 529 (not shown) can similarly swivel.

The device in FIG. 1B is shown in the deployed configuration. In this configuration, the device 1 may roll on all four wheels along a surface 5. The surface 5 may be a paved surface, such as a street or sidewalk, or an unpaved surface, such as a dirt or gravel road. The surface may also be an interior surface such as a floor or walkway, including tile, brick, carpet, etc. The lightweight structure of the device 1 and the wheelbase, or the spacing between the wheels 810, along with the size of the wheels 810, allow for use of the device 1 on rugged terrain. Dirt, rocks, bumps, plants and other small obstacles may be overcome while using the device 1.

Further depicted in FIG. 1B is a deployed height 10 and a deployed length 30. The deployed height 10 is the vertical distance from the bottom of the wheels 810 to the top of the handle 200. The length 30 is the horizontal distance from the rearward-most part of the device 1 to the forward-most part. In some embodiments, the length 30 is from the back of the wheel 830 to the front of the wheel 810 on the same side of the device 1. Further, the device 1 may have a deployed wheelbase length 32. This is the horizontal distance from axis of rotation of the rear wheel 830 to the axis of rotation of the front wheel 810. As mentioned, this provides forward and backward stability to the device 1 such it will not easily tip over in those directions. As discussed in further detail herein, for example with respect to FIG. 1D, the lateral separation of the wheels 800 provides lateral stability such that the device 1 will not easily tip over laterally. In some embodiments, the deployed height 10 is forty two inches (42") and the deployed length 30 is thirty four inches (34"). In some embodiments, the deployed wheelbase length 32 is twenty four inches (24").

Figure 1C:
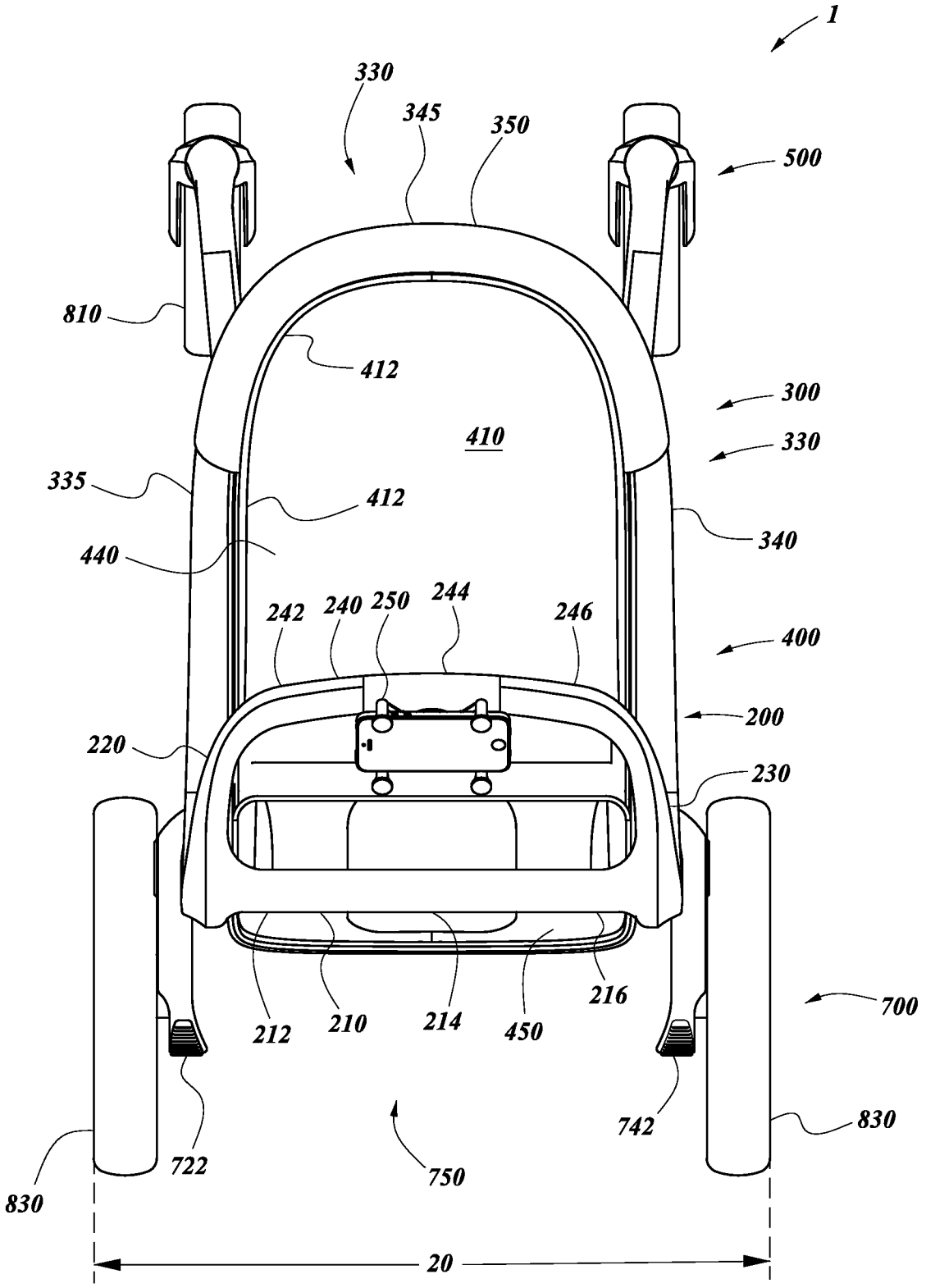
FIG. 1C is a top view of the device of FIG. 1A.

FIG. 1C is a top view of the device 1 in the deployed configuration. The tops of the handle 200 and upper basket 400 on the upper section 300 are shown. Further visible are the front wheels 810 on the forward section 500 and the rear wheels 830 of the rearward section 700. As shown, the overall deployed width 20 is the lateral distance between the left and right sides of the device 1. In some embodiments, the width 20 is the lateral distance from the outside of the left rear wheel 830 to the outside of the right rear wheel 830. In some embodiments, the width 20 is twenty one and three-fifths inches (21.6") This may also be the width of the device 1 in the collapsed configuration.

The handle 200 includes the rear elongated portion 210, the left forward portion 220, the right forward portion 230, and the forward elongated portion 240. The rear portion 210 includes a rear left end 212, a rear right end 216, and a rear subportion 214 as shown. The rear portion 210 is essentially straight and of uniform thickness. It is roughly horizontal and provides a structural member for a user of the device 1 to grasp for support while moving. The rear portion 210 may be substantially lateral as shown or it may be off lateral. In some embodiments, the rear portion 210 is at an angle. In some embodiments, the rear portion 210 is partially horizontal and partially at an angle. For instance, the middle section of the rear portion 210 may be horizontal while outer sections on either side of the middle section are angled, or vice versa. In some embodiments, the left end 212 and the right end 216 are curved and the subportion 214 is straight. Further, the thickness across the rear portion 210 may vary. In some embodiments, the subportion 214 may be thicker or thinner than the ends 212, 216. In some embodiments, the thickness varies with impressions to accommodate a hand and/or fingers gripping the rear portion 210. Underneath the rear portion 210 may be the brake actuator 910 (not shown in FIG. 1C). In some embodiments, the actuator 910 is a bar or elongated member extending underneath the rear portion 210.

From the rear portion 210, the left forward portion 220 and the right forward portion 230 extend forward and slightly inward to the forward portion 240. In some embodiments, the left and right forward portions 220, 230 extend straight forward, inward, and/or outward, or combinations thereof. The portions 220, 230 couple to the forward elongated portion 240. The transition from the left and right forward portions 220, 230 to the forward portion 240 is curved and smooth. In some embodiments, the transition is sharp. In some embodiments, the transition is combinations of smooth curves and sharp corners.

The forward elongated portion 240 includes a forward left end 242, a forward right end 246 and a forward subportion 246 in between the ends 242, 246. The ends 242, 246 may be curved as mentioned. The subportion 246 may be straight. In some embodiments, the subportion 246 is straight and substantially horizontal. As shown, the handle 200 defines a space surrounded by the forward elongated portion 240, the rear elongated portion 210 and the left and right forward portions 220, 230. This space is substantially rectangular with rounded corners. In some embodiments, the space may be other shapes of various sizes and aspect ratios. For example, the space may be square or triangular, or it may be a rectangle with a shorter width or longer length, etc. Underneath the forward portion 240 may be the brake actuator 910 (not shown in FIG. 1C). In some embodiments, the actuator 910 is a bar or elongated member extending underneath the forward portion 240. In some embodiments, a first actuator 910 is underneath the rear portion 210 and a second actuator 910 is underneath the forward portion 240.

The cradle 250 is further shown on the forward elongated portion 240 of the handle 200. The cradle is facing rearward and is slightly angled. Four pegs on the cradle 250 facilitate capturing and holding a mobile device. A user may place a mobile device in the cradle 250 while using the mobility assistance device 1. The cradle 250 is shown near the middle of the forward elongated portion 240. In some embodiments, the cradle 250 is on other locations of the forward elongated portion 240. In some embodiments, the cradle 250 is on other parts of the handle 200, such as the rear elongated portion 210, etc.

Extending forward of the handle 200 is the upper rim 330 of the upper section 300. The left side rim portion 335 and the right side rim portion 340 extend forward along the sides of the device 1. The portions 335, 340 are substantially straight. In some embodiments, the portions 335, 340 are angled straight, outward, and/or inward, or combinations thereof. At the forward ends of the portions 335, 340 is the forward rim portion 345. The forward rim portion 345 is a lateral part of the upper rim 330 that runs essentially laterally. The outer ends of the forward rim portion 345 are curved and create a smooth, curved transition from the left and right side rim portions 335, 340 to the forward rim portion 345. In some embodiments, this transition may be smooth, sharp, or combinations thereof. The forward rim portion 345 further includes a forward rim subportion 350. The subportion 350 may be a substantially straight section of the forward rim portion 345. In some embodiments, the subportion 350 is straight and horizontal. However, the subportion 350 may further be curved, straight, or combinations thereof.

Further shown in FIG. 1C are the forward compartment 440 and the rearward compartment 450 defined by the upper basket 400. The forward compartment 440 is the storage area toward the front of the upper basket 400 that holds and carries items. The bottom of the forward compartment 440 is the upper plane 410 having a perimeter 412. The perimeter 412 is along the outer boundary of the upper plane 410 and couples to the enclosure 460 (discussed, for example, with respect to FIGS. 1A-1B). The perimeter 412 may have a similar shape and size as the upper rim 330 as viewed from the top. In some embodiments, the perimeter 412, and thus the upper plane 410, have a different shape and/or size as the upper rim 330 as viewed from the top. The forward compartment 440 may be bounded on the rear side by the divider 430 (not shown). On the other side of the divider 430 may be a rearward compartment 450. The rearward compartment 450 is the storage area toward the rear of the upper basket 400 that holds and carries items. The rear compartment 450 may comprise more than one subcompartment. In some embodiments, the rear compartment 450 comprises two subcompartments near the sides of the basket 400. In some embodiments, the rear compartment 450 defines an opening vertically through the upper basket 400, with a subcompartment on either side of the opening.

Near the rear of the device 1 are a left kickplate 722 and a right kickplate 742. In some embodiments, kickplates 722, 742 facilitate with lifting the front of the device 1. For instance, a user may push down on one or both of the kickplates 722, 742 while pulling back on the handle 200 in order to rotate the entire device upward from the front. This will raise the forward wheels 810 off the ground and may be useful, for instance, to get over a bump or curb on the surface 5 on which the device 1 is being operated. The left kickplate 722 and the right kickplate 742 are near the rear and bottom of the device 1 on the rearward section 700. For instance, the left kickplate 722 may be on the lower end 720 of the left rearward section 710. The kickplate 722 may also be on the inside of the rear wheel 830, between the wheel 830 and the lower end 720 of the left rearward section 710, or in other locations or configurations that facilitate rotating the device 1 partially using one's foot. Similar features and functionalities apply to the right kickplate 742 on the right side of the device 1.

Figure 1D:
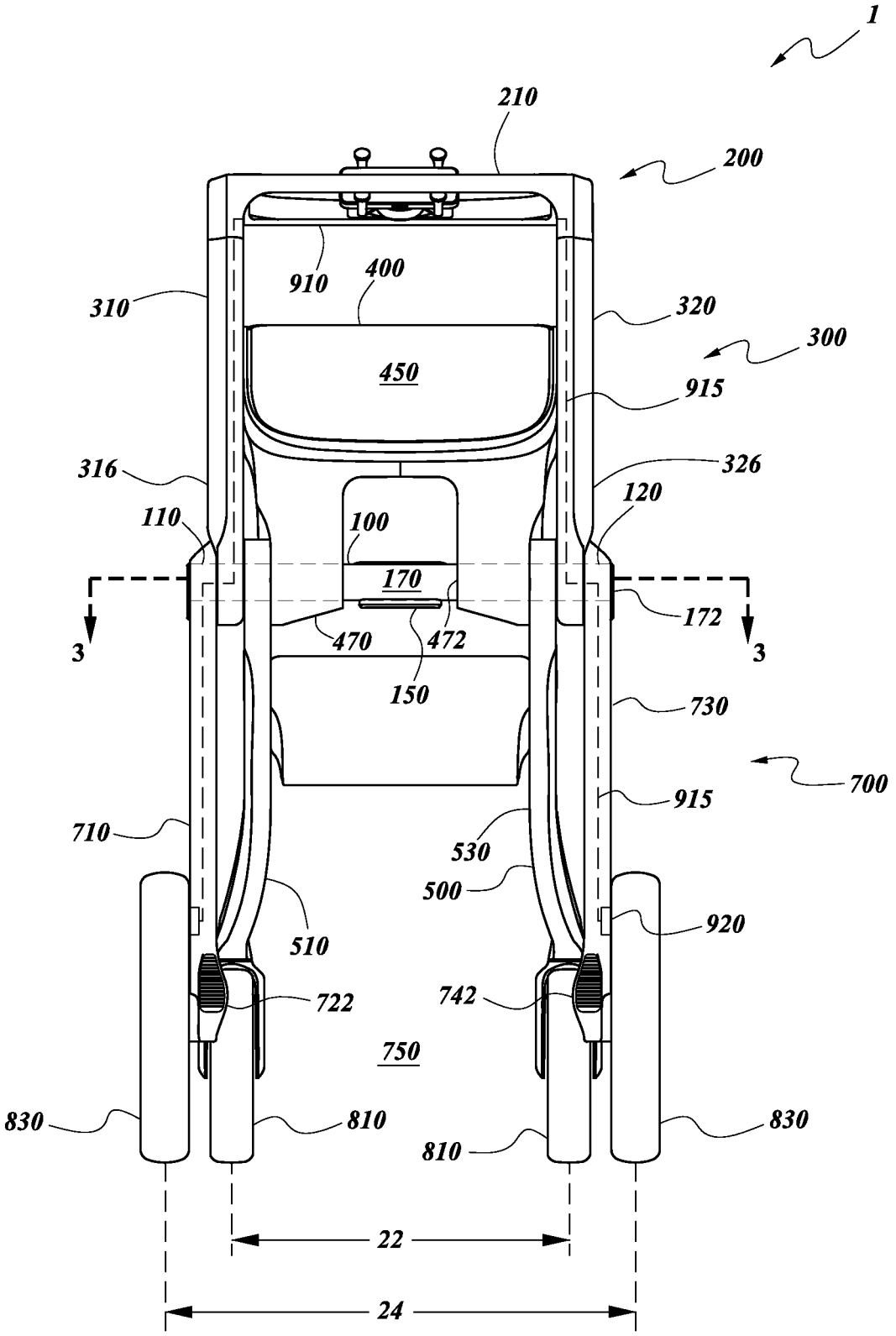
FIG. 1D is a rear view of the device of FIG. 1A.

FIG. 1D is a rear view of the device 1. Middle portions of the axis 100 are partially visible. Parts of the axis 100 that are behind other parts in the view shown are indicated with dashed lines. The axis 100 is horizontal and runs laterally between left and right sides of the device 1. The axis 100 interacts with the upper section 300, the forward section 500, and the rearward section 700. In some embodiments, the axis 100 couples with each section at a left pivot joint 110 and a right pivot joint 120.

At the pivot joints 110, 120, the various sections may surround the axis 100 such that they may rotate about the axis 100. As shown, the rearward section 700 may be toward the outside of the axis 100, the forward section 500 may be toward the inside of the axis 100, and the upper section 300 may be in between the rearward and forward sections 700, 500. In some embodiments, the order of the various sections from inside to out may be different. For instance, the rearward section 700 may be toward the inside of the axis 100, the forward section 500 may be toward the outside of the axis 100, and the upper section 300 may be in between the rearward and forward sections 700, 500, etc.

Further coupled to the axis 100 is the upper basket 400. The rear compartment 450 of the upper basket is shown above the axis 100. The basket 400 may be coupled to the axis 100 via projections 470 on the rear and underside of the basket 400. The projections 470 extend downwardly from the basket 400 and comprise slots 472. The slots 472 are spaces or openings in the projections 470 that receive the axis 100. The basket 400 can thus rotate or pivot about the axis 100 via the slots 472 on the projections 470. In some embodiments, the basket 400 can independently, or partially independently, rotate about the axis 100 via the projections 470. The projections 470 may include rotatable features to facilitate rotation of the basket 400, such as bearings, bushings, soft structures like rubber, etc. or combinations thereof.

The axis 100 may be accessible between the projections 470 of the upper basket 400. In this area of the axis 100, a release 150 may advantageously be located. The release 150 may be coupled with a locking mechanism 170 and thereby allow for rotation of the various rotatable sections of the device 1. Actuation of the release 150 may actuate or unlock the locking mechanism 170, and the mechanism 170 may be locked or may automatically re-lock when the release 150 is not actuated. When the release is actuated, the sections are thus allowed to rotate. When the release is not actuated, the rotatable sections are opposed or prevented from rotating, but in some embodiments may continue to rotate from a first locked position to a second locked position, and automatically lock when reaching the second locked position.

The release 150 may be a lever or levers on the axis 100. In some embodiments, the release 150 is an elongated button on the top of the axis 100 and an elongated button on the bottom of the axis 100, such that a user may grasp the axis 100 with one hand and thereby depress both buttons of the release 150 to actuate it. The release 150 may also be one or more buttons, shorter buttons, levers, tabs, etc., or combinations thereof.

On either end of the axis 100 is a locking mechanism access 172. The access 172 may be located on both sides of the axis 100 as shown. As mentioned, the access 172 may provide access to features that adjust the locking mechanism 170.

Further shown in FIG. 1D, the rear wheels 830 may be laterally farther apart than the forward wheels 810. The lateral separation of the rear wheels 830 is indicated by the rearward wheelbase width 24 and the lateral separation of the forward wheels 810 is indicated by the forward wheelbase width 22. As shown, the rear width 24 is longer than the forward width 22. This may allow for the rear wheels 830 to rotate up and over the forward section 500 when the device 1 is in the collapsed configuration. In some embodiments, the rearward wheelbase width 24 is nineteen and three-fifths inches (19.6"). In some embodiments, the forward wheelbase width 22 is fourteen and three-fifths inches (14.6"). The left and right side supports 510, 530 of the forward section 500 are curved as shown so as to allow the rearward section 700 to fold up and partially around the forward section 500. In some embodiments, the left and right side supports 510, 530 are straight but spaced closer together to allow such folding. In some embodiments, the left and right side supports 510, 530 are straight, curved, or combinations thereof.

In between the rear wheels 830 and near the rear of the device 1 is an unobstructed space 750. The space 750 in some embodiments is defined by the inner portions of the rearward section 700 and the forward section 500 as well as the undersides of the upper basket 400. The space 750 provides an open space in which the user or other items may enter. For instance, a user may take wide or long strides inside the space 750 while using the device 1 without contacting any of the structure of the device 1.

As mentioned, the device 1 may further have a brake system 900 including a brake actuator 910. The brake actuator 910 may be underneath the rear portion 210 of the handle 200. The actuator 910 is shown coupled to a brake linkage 915. Actuation of the actuator 910 will actuate the linkage 915. In some embodiments, pulling up on the actuator 910, such as a bar, will cause the linkage 915 to be pulled toward the handle 200. The brakes 900 may be operated by a user using one or two hands. The brakes 900 may include a quick acceleration sensing emergency braking system. The linkage 915 may be coupled on the opposite end to brakes 920. Various configurations of the brakes 920 may be implemented, including air brakes, hydraulic brakes, disc brakes, drum brakes, and power brakes. In some embodiments, the brake actuator 910 includes a catch to keep the brakes 920 in an actuated state to keep the device 1 from moving. The brakes 920 as shown are pads that contact the rear wheels 830. As the actuator 910 is actuated, the pads increase contact with the wheels 830, thus imparting an increasing braking force to the wheels, and thereby slowing or stopping the device 1. The brakes 920 may be in a number of configurations and orientations, including rubber or other materials that are configured to contact the wheel axes, the wheel hub, the wheel tire, etc. The brakes 920 may include cables or other wires that may be concealed, for example extending through the various sections of the device 1 from the brakes 920 to the actuator 910.

Figure 2A:
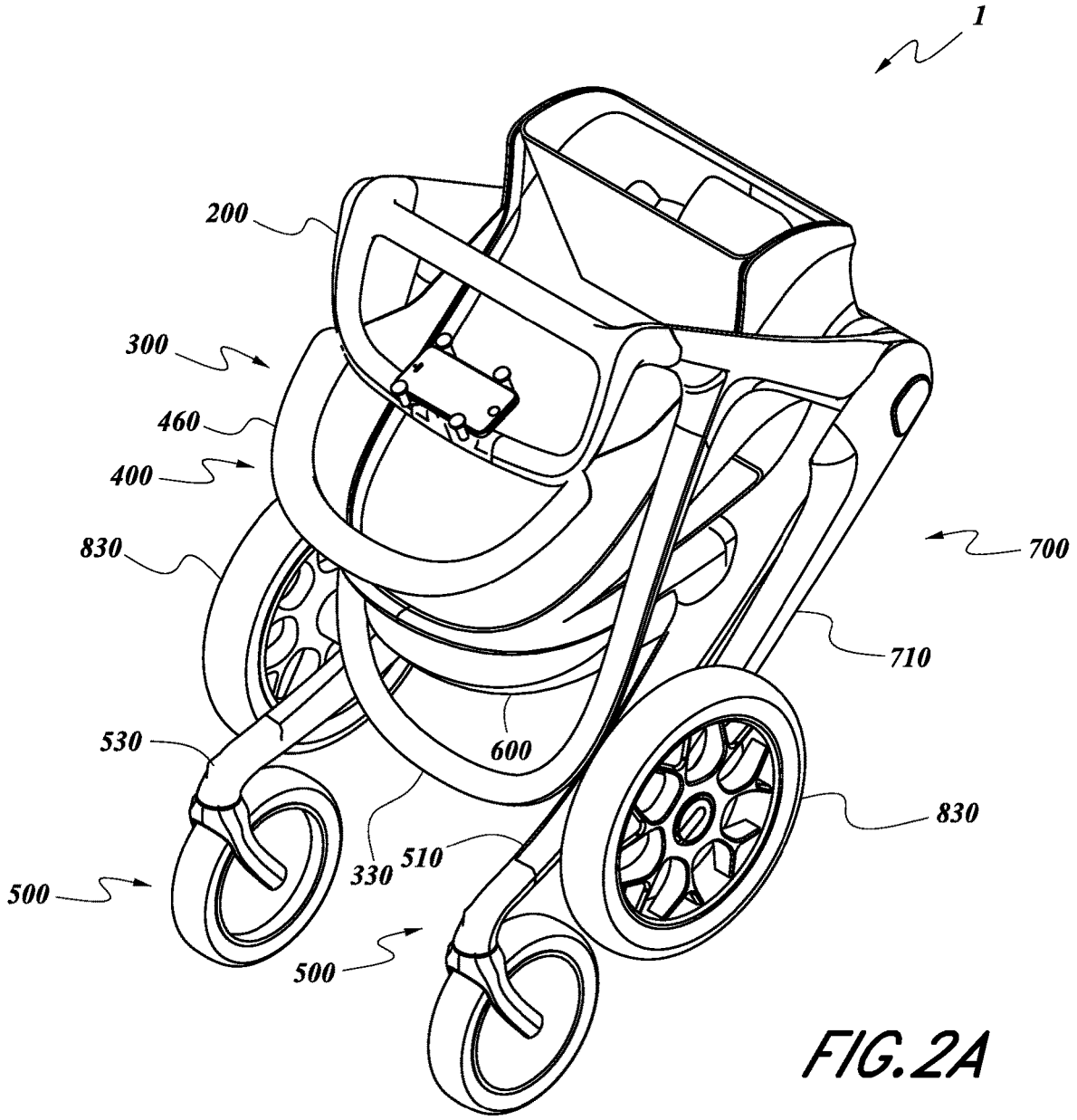
FIG. 2A is a perspective view of an embodiment of a mobility assistance device in a collapsed configuration.

FIG. 2A is a perspective view of an embodiment of the mobility assistance device 1 in a folded or collapsed configuration. The upper section 300, forward section 500 and rearward section 700 have been folded together to transform the device 1 into a smaller and portable configuration. The upper section 300 has been pivoted or rotated toward the forward section 500 and rearward section 700. Similarly, the rearward section 700 has been pivoted or rotated toward the upper section 300 and the forward section 500. The sequence of folding or rotating the various sections can take a number of forms. For instance, the rearward section 700 may be stationary while the upper section 300 and the forward section 500 are both rotated towards the rearward section 700. Or, the upper section 300 may be stationary while the rearward section 700 and the forward section 500 are both rotated towards the upper section 300. Additionally, the forward section 500 may be held stationary while both the upper section 300 and the rearward section 700 are rotated towards the forward section 500. Other variations to the sequence of rotations may be implemented. Further, the various sections may be rotated one at a time or simultaneously. The device 1 in the collapsed configuration may be free-standing and have stable intermediate support such it can be stood up on the ground without needing outside support, for example for easier loading into a vehicle. In some embodiments, the device 1 may not be capable of being configured into the collapsed configuration. In some embodiments, multiple devices 1 may be nested or otherwise stacked together, for example for space-saving storage of multiple devices 1. The devices 1 may be nested together in the collapsed configuration or in the deployed configuration.

As shown, the rearward section 700 and the forward section 500 have been rotated closer to each other. The rear wheels 830 of the rearward section 700 are on the outside of the forward section 500. The left rearward section 710 is next to and on the outside of the left side support 510. Although not visible in FIG. 2A, the right rearward section 730 is also next to and on the outside of the right side support 530. After the rearward section 700 and the forward section 500 have been rotated to the configuration shown, they may be locked out so that they stay in this configuration. In some embodiments, the rearward section 700 and the forward section 500 are locked out using the release 150 and the locking mechanism 170. In some embodiments, the rearward section 700 may couple with the forward section 500 in the collapsed configuration. For example, the rearward section 700 may have a latch that can be connected to a mating latch on the forward section 500.

Further shown is the upper section 300 rotated towards the forward and rearward sections 500, 700. As with the rotation of the forward section 500 and/or rearward section 700, the upper section 300 may be rotated in a number of different sequences. For example, the upper section 300 may first be rotated toward the forward section 500 and then the rearward section 700 rotated toward the forward section 500. Or, both the upper section 300 and the forward section 500 may be rotated towards the rearward section 700. Other variations to the sequence of rotations may be implemented. Further, the various sections may be rotated one at a time or simultaneously.

The various parts of upper section 300 may be rotated to varying degrees and/or in different sequences. In some embodiments, the upper basket 400 may rotate independently or semi-independently of the rest of the upper section 300. In some embodiments, the upper rim 330 may rotate separately from the upper basket 400. As shown, the upper rim 330 has been rotated further toward the rearward section 700 and forward section 500 than has the upper basket 400. Further, the upper rim 330 has been partially received by the forward section 500. This allows the collapsed configuration of the device 1 to be more compact.

Figure 2B:
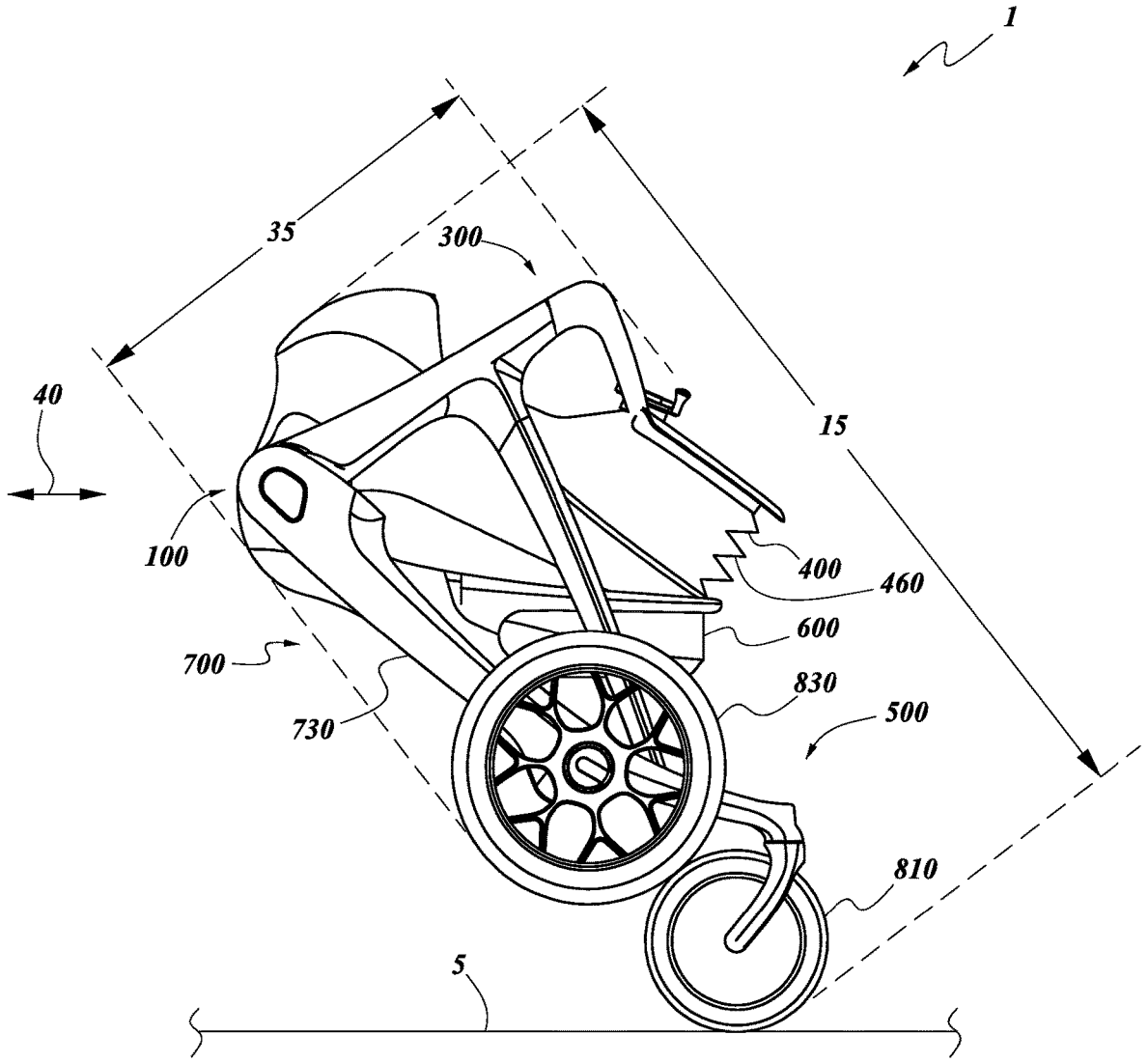
FIG. 2B is a side view of the device of FIG. 2A.

FIG. 2B is a side view of an embodiment of the device 1 in a collapsed configuration. As shown, the lower basket 600 has partially received the upper basket 400. This allows for a more compact collapsed configuration. Further, the enclosure 460 has collapsed or folded to allow for the upper basket 400 to rotate closer to the lower basket 600 and forward section 500. The forward wheels 810 of the forward section 500 are shown beneath the rear wheels 830 in the orientation shown. The device 1 may thus be moved on the two forward wheels 810 in the collapsed configuration. The axis 100 may be gripped between the projections of the lower basket 600 and the device 1 may be pushed or pulled on the forward wheels 810. In some embodiments, a user my grab the device 1 by the axis 100 and tow or pull the device 1 behind them as they walk.

The dimensions of the collapsed device 1 are further shown in FIG. 2B. A collapsed length 15 and a collapsed height 35 are indicated. These are the longest length and height dimensions of the device 1 in the collapsed configuration. In some embodiments, the collapsed length 15 is thirty three and seven-tenths inches (33.7") and the collapsed height 35 is nineteen and four-fifths inches (19.8"). Various features of the device 1 allow for such a compact collapsed configuration. As mentioned, the upper section 300 and the forward section 500 may rotate toward the interior of the rearward section 700. This allows the larger rear wheels 830 on the outside of the rearward section 700 to be conveniently stored out of the way of the other rotating parts and allows for a more compact rotation. Further, as mentioned, the upper rim 330 is partially received by the forward section 500, the enclosure 460 of the upper basket 400 can collapse, the upper rim 330 can separate from the upper basket 400, etc. These are just some examples of features that allow for a compact collapsed configuration. Other similar features and functionalities of the device 1 not explicitly addressed herein are within the scope of the present disclosure. Further, these are just some of the configurations and positions of the various parts of the device 1 that may be implemented. They do not limit the scope of the disclosure but are merely given as examples of certain embodiments. For instance, in some embodiments, the rear wheels 830 of the rearward section 700 may be on the interior of the forward section 500 when in the collapsed configuration.

Figure 3:
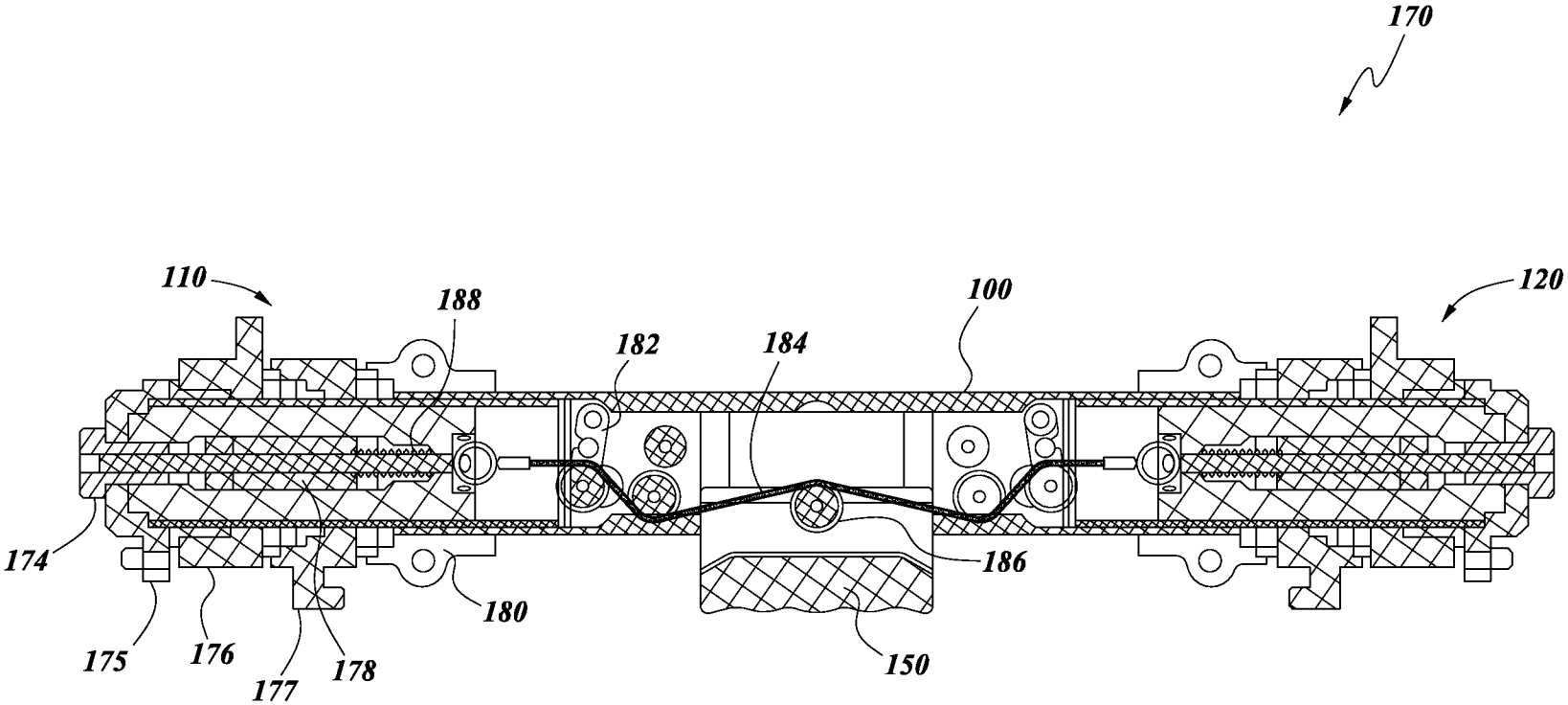
FIG. 3 is a section view of an embodiment of a locking mechanism that may be used in the device of FIG. 1A, taken along the line 3-3 in FIG. 1D.

FIG. 3 is a section view of an embodiment of a locking mechanism 170 that may be used in the device of FIG. 1A. The locking mechanism 170 may be housed in the axis 100 as shown. The release 150 may be coupled with the axis 100 and other parts of the mechanism 170. The release 150 is a moveable member, such as a button, that may be pressed in toward the interior of the axis 100.

The release 150 couples with a cable 184. A user may grasp the axis 100 and press in the release 150, thereby pushing on the cable 184. As shown, the release 150 may have a pulley 186 or other round tab over which the cable 184 extends. Pressing in on the release 150 may cause the pulley 186 to press in on the cable 184, thereby tensioning the cable 184.

The cable 184 extends over one or more tensioners 182. The tensioners 182 may be adjusted to adjust the tension in the cable 184. For instance, the tensioner 182 may be moved so that more or less tension is created in the cable 184 for a given translation of the release 150. In some embodiments, the tensioner 182 as shown may be slid to the left to decrease the tension in the cable 184 or slid to the right to increase the tension in the cable 184.

The cable 184 is further coupled with a locking member 178. In some embodiments, the locking member 178 is a locking key. The member 178 may translate from a locked position to an unlocked position. When the tension in the cable 184 is increased, the cable 184 may pull the member 178 from a locked position to an unlocked position. When the tension in the cable 184 is decreased, then the member 178 may move back to the locked position. The member 178 may move to the locked position with a restoring member 188, such as one or more compression springs.

When the locking member 178 is in the locked position, it is engaged with one or more section couplings 175-177. A rearward section coupling 175 may couple with the rearward section 700. In some embodiments, the rearward section coupling 175 is a collar to which the rearward section 700 attaches or otherwise couples. An upper section coupling 176 may couple with the upper section 300. In some embodiments, the upper section coupling 176 is a collar to which the upper section 300 attaches or otherwise couples. A forward section coupling 177 may couple with the forward section 500. In some embodiments, the forward section coupling 177 is a collar to which the forward section 500 attaches or otherwise couples. When the various couplings 175-177 are engaged by the locking member 178, the couplings 175-177 are prevented from rotating. Therefore, the respective sections of the device 1 coupled to the couplings 175-177 are similarly prevented from rotating. When the various couplings 175-177 are not engaged by the locking member 178, the couplings 175-177 are not prevented by the locking member 178 from rotating. Therefore, the respective sections of the device 1 coupled to the couplings 175-177 are similarly not prevented by the locking member 178 from rotating.

The force required to rotate the various sections is controlled by an adjustor 174. As mentioned access to part of the locking mechanism 170 may be via the access 172 (not shown in FIG. 3). The access 172 may be removed to reveal the adjustor 174. The adjustor 174 allows for adjustment of the force and/or speed of rotation of the various sections. In some embodiments, the adjustor 174 is a bolt that may be tightened or loosened to control the force and/or speed. In some embodiments, the mechanism 170 has more than one adjustor 174. In some embodiments, the mechanism 170 has two adjustors 174. In some embodiments, the mechanism 170 has an adjustor 174 to control rotations of various parts of the device 1 about the left pivot joint 110 and another adjustor to control rotations of various parts of the device 1 about the right pivot joint 120.

Figure 4A:
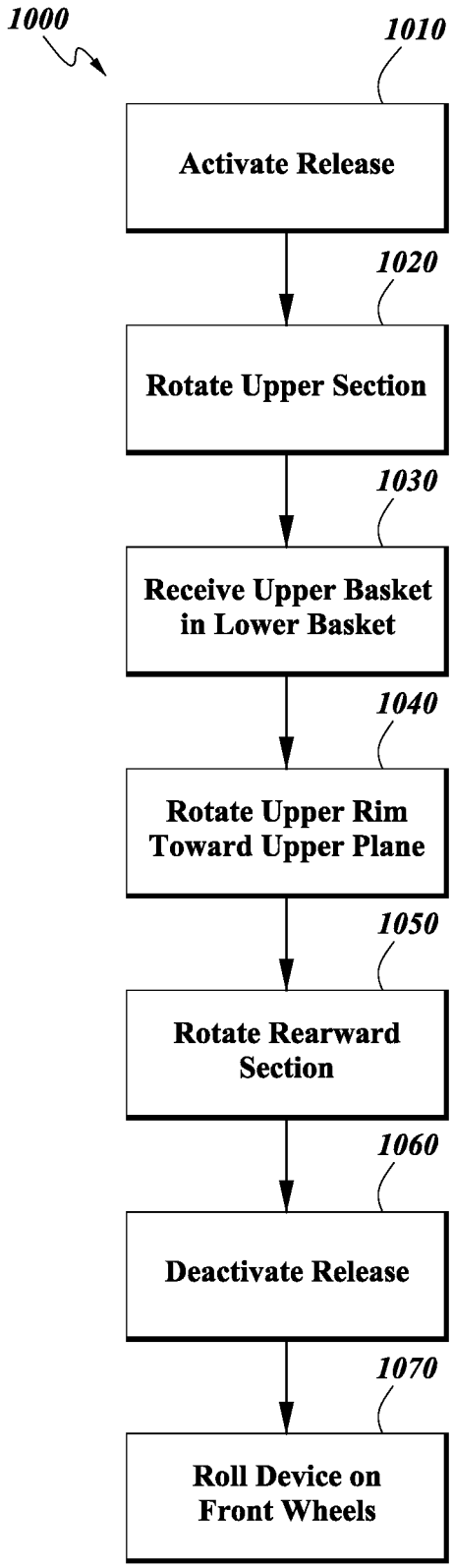
FIG. 4A is a flowchart of an embodiment of a method for collapsing a mobility assistance device.

FIG. 4A is a flowchart of an embodiment of a method 1000 for collapsing the mobility assistance device 1. The method 1000 may be used on the device 1 in a deployed, partially deployed or partially collapsed configuration. In a first step 1010, the release 150 is activated. This may be the release 150 on the axis 100. In some embodiments, the release 150 is a button that is actuated by depressing the button. In some embodiments, the release 150 is a handle that is actuated by pushing or pulling on the handle. The release 150 may automatically stay in an actuated state or it may automatically stay in an unactuated state. In some embodiments, the release 150 must be constantly actuated by a user for the release 105 to remain in the actuated state. In some embodiments, the release 150 may be actuated once by a user, for instance by applying pressure to depress a button, and the release 105 will remain in the actuated state once the user removes the applied pressure.

With the release actuated, the method 100 moves to step 1020 wherein the upper section 300 is rotated. The upper section 300 may be rotated toward the other sections of the device 1. In some embodiments, the upper section 300 rotates in parts. For example, the upper basket 400 may rotate independently or semi-independently from the rest of the upper section 300. The upper section 300 may be rotated until it contacts another portion of the device 1, such as the forward section 500 or rearward section 700. In some embodiments, the other sections are rotated toward the upper section 300. For example, the upper section 300 may be stationary while the forward section 500 and the rearward section 700 are rotated toward the upper section 300. Therefore, all that is required for rotation of the upper section 300 is relative rotation between the upper section 300 and the other sections or parts of the device 1.

Next, in step 1030, the upper basket 400 is received by the lower basket 600. The upper basket 400 may rotate independently of the rest of the upper section 300 such that the upper basket 400 is received in the lower basket 600. In some embodiments, part of the upper basket 400 is received by the lower basket 600. In some embodiments, the forward portions of the upper basket 400 are received by the lower basket 600. In some embodiments, the upper basket 400 is rotated toward the lower basket 600. In some embodiments, the lower basket 600 is rotated toward the upper basket 400. In other embodiments, both the lower basket 600 and the upper basket 500 are rotated such that there is relative rotation between the two that brings them closer together.

The upper rim 330 may then be rotated toward the upper plane 410 in step 1040. With the upper basket 400 received by the lower basket 600, the upper basket 400 will be prevented from further rotation. However, the remaining parts of the upper section 300 may be further rotated. In some embodiments, the upper rim 330 may be rotated further toward the upper plane 410 as well as toward the forward section 500. In some embodiments, portions of the upper section 300 are received by the forward section 500. For instance, the upper rim 330 may be received or partially received by the forward section 500. As with other rotations of the device 1, all that is required is relative rotation of the upper rim 330 with the other indicated parts of the device 1 such that the upper rim 330 and the various parts are closer together after rotation. For example, the upper plane 410 and upper basket 400 may be rotated toward the upper rim 330 in step 1040.

Next, in step 1050, the rearward section 700 is rotated. The rearward section 700 may be rotated toward the forward section 500 and the upper section 300. In some embodiments, the forward section 500 and the upper section 300 are rotated toward the rearward section 700. Therefore, different rotations may be implemented that constitute rotation of the rearward section 700. Again, all that is required is relative rotation of the rearward section 700 with the indicated parts of the device 1 such that the rearward section 700 and the various parts are closer together after rotation.

With the various sections and/or parts rotated toward or in a collapsed configuration, the method 100 moves to step 1060 wherein the release 150 is deactivated. The release 150 may be automatically deactivated after the various sections and/or parts are rotated. For instance, once all sections are fully in, or any other portion in, the collapsed configuration, the release 150 may automatically deactivate. The release 150 may also be manually deactivated. For instance, once the desired configuration is achieved, the release 150 may be manually deactivated by a user. For example, in the collapsed configuration, the release 150 may be a button that is depressed again to deactivate it.

Finally, the device 1 may be rolled on the front wheels 810 in step 1070. In some embodiments, the device 1 is pulled or towed by grasping the axis 100 with a hand. In some embodiments, the device 1 is pushed on its front wheels 810. The device 1 may be rolled in the collapsed configuration or a partially collapsed configuration where the various sections are partially rotated.

Figure 4B:
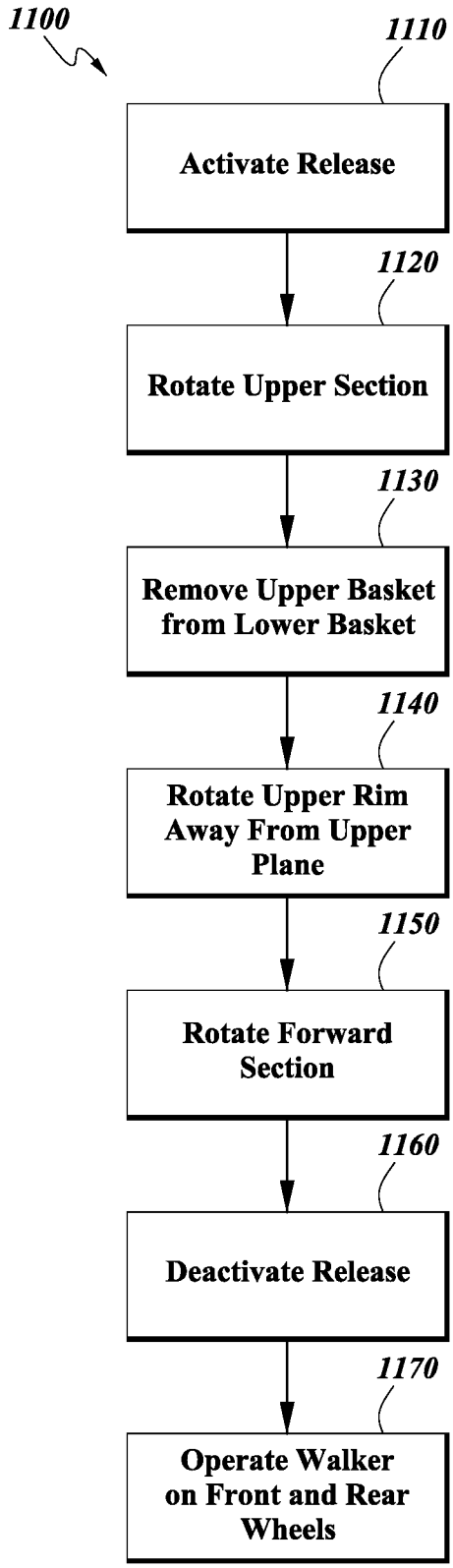
FIG. 4B is a flowchart of an embodiment of a method for deploying a mobility assistance device.

FIG. 4B is a flowchart of an embodiment of a method 1110 for deploying a mobility assistance device 1. The method may be employed with the device 1 described above with respect to FIGS. 1A-2B. The device 1 may be in a collapsed configuration or a partially collapsed configuration. The method 1100 begins with step 1110 wherein the release 150 is activated. This step is similar to the step 1010 in method 1000 described with respect to FIG. 4A. The next step in method 1100 is step 1120 wherein the upper section 300 is rotated. The upper section 300 may be rotated away from the forward section 500 and/or the rearward section 700. Rotation of the upper section 300 may also rotate components associated with the upper section 300, such as the handle 200. In some embodiments, the upper section 300 is rotated from a collapsed configuration where the upper rim 330 has separated from the upper basket 400. Therefore, rotation of the upper section 300 may not rotate certain components associated with the upper section 300, such as the upper basket 400. In some embodiments, the upper rim 330 is rotated partially and then the upper basket 400 begins to rotate with it.

The process then moves to step 1130 wherein the upper basket 400 is removed from the lower basket 600. The upper basket 400 may be partially received by the lower basket 600 such that rotation of the upper basket 400 removes it from the lower basket 600. This may also involve an unfolding of the enclosure 460 on the upper basket 400. In some embodiments, the enclosure 460 is unfolded first and then the upper basket 400 is removed from the lower basket 600. In some embodiments, the upper section is rotated from the previous step and then after a certain amount of rotation the upper rim 330 couples with the upper basket 400 such that further rotation of the upper section 300, and thus of the upper rim 330, begins to unfold the enclosure 460. Once the enclosure 460 is completely unfolded, then, with further rotation of the upper section 300, the upper basket 400 may begin to be removed from the lower basket 600. With still further rotation, the upper basket 400 may be completely removed from the lower basket 600.

Next, in step 1140, the upper rim 330 is rotated away from the upper plane 410. This may be before, after or concurrent with the removal of the upper basket 400 from the lower basket 600 in the previous step 1130. For instance, the upper rim 330 may be rotated away from the upper plane 410. Next, the upper rim 330 may couple with the upper basket 400 and, with further rotation, the upper rim 330 may rotate the upper edge 462 of the enclosure 460 away from the upper plane 410 and finally remove the upper basket 400 from the lower basket 600. Therefore, as mentioned elsewhere, the order of description of the steps in this method 1100 and other methods does not limit the scope of the method. The method 1100 may be carried out in the order it is described or in other sequences.

The forward section 500 is then rotated in step 1150. The forward section 500 may be rotated away from the upper section 300 and/or away from the rearward section 700. In some embodiments, the forward section 500 is rotated relative to the rearward section 700 such that either the forward section 500 is rotated while the rearward section 700 is held stationary, or the rearward section 700 is rotated while the forward section 500 is held stationary. Therefore, all that is required is relative rotation between the forward section 500 and the upper section 300 and rearward section 700. The forward section 500 and rearward section 700 may be rotated to a deployed configuration, as shown in FIGS. 1A-1D. They may also be rotated to a partially deployed configuration.

Next, in step 1160, the release 150 is deactivated. This may be similar to the step 1060 in method 1000 described above with respect to FIG. 4A. Finally, the device 1 may be operated on its wheels in step 1170. In some embodiments, the device 1 is rolled on the front and rear wheels 800. A user may lean on the handle 200 in various positions and at various angles for support while walking or otherwise moving with the device 1.

Although this invention has been disclosed in the context of certain preferred embodiments and examples, it will be understood by those skilled in the art that the present invention extends beyond the specifically disclosed embodiments to other alternative embodiments and/or uses of the invention and apparent modifications and equivalents thereof. In addition, while a number of variations of the invention have been shown and described in detail, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A mobility assistance device having a front, a back, a left, and a right, the device comprising:

an upper section comprising a substantially horizontal handle extending between a left and a right side of the upper section, wherein the handle is configured for an average size adult person to grasp the handle while standing upright with the person's arms extending forward with elbows at the person's sides, and wherein the handle is located at a height sufficient for the person to rest the person's forearms on the handle when the person's elbows are substantially below the person's shoulders and in front of the person's body;

a horizontal pivot axis extending through the upper section;

a forward section comprising:

left and right forward rim portions rigidly coupled with the left and right sides of the forward section, respectively; and a front portion rigidly coupled to the left and right forward rim portions and having a front rim subportion substantially parallel to the pivot axis;

a rearward section;

left and right front wheels rotationally mounted on the forward section;

left and right rear wheels rotationally mounted on the rearward section;

a left pivot joint and a right pivot joint located on the pivot axis, at which left and right sides of the upper section, the forward section, and the rearward section of the device are respectively joined, wherein the upper section, the forward section, and the rearward section are configured to pivot relative to each other at the left and right pivot joints;

a lower basket coupled with the front portion, the left forward rim portion, the right forward rim portion and the forward section and extending forward from the forward section; and an upper basket, wherein the lower basket partially receives the upper basket when the device is in a folded configuration.

2. The mobility assistance device of claim 1, wherein the upper section, the forward section, and the rearward section are configured to pivot relative to each other between folded and deployed configurations.

3. The mobility assistance device of claim 2, wherein, in the deployed configuration, the device is configured to be operated on a surface with the front and rear wheels on the surface while an operator grasps the handle and ambulates behind the device.

4. The mobility assistance device of claim 2, wherein, in the folded configuration, the device is configured to be operated on a surface with the front wheels on the surface while an operator grasps a member through which the pivot axis extends.

5. The mobility assistance device of claim 1, wherein the upper section is a single molded or machined piece or multiple pieces rigidly connected.

6. The mobility assistance device of claim 1, wherein the rearward section comprises:

a left rearward section extending downwardly from the left pivot joint to the left rear wheel; and a right rearward section extending downwardly from the right pivot joint to the right rear wheel, wherein the device has a substantially unobstructed space between the left and right rearward sections and between the rear wheels such that the person's feet and legs can swing into the unobstructed space beyond at least a portion of the rear wheels while the person is ambulating behind the device.

7. The mobility assistance device of claim 1, further comprising:

a release;

and a locking mechanism coupled with the release, wherein deactivating the release causes the locking mechanism to oppose pivoting of the upper section, the forward section, and the rearward section relative to each other, and wherein activating the release causes the locking mechanism to not oppose pivoting of the upper section, the forward section, and the rearward section relative to each other, and wherein the release deactivates when the device is in folded and deployed configurations.

8. The mobility assistance device of claim 1, further comprising:

brakes coupled with at least one of the wheels; and at least one brake actuator coupled with the handle and configured to actuate the brakes, wherein actuating the brakes opposes rotation of the at least one of the wheels with which the brakes are coupled.

9. The mobility assistance device of claim 1, the handle comprising:

a rear elongated portion comprising:

a rear subportion substantially parallel to the pivot axis, and left and right rear ends rigidly coupled with the rear subportion and the left and right sides, respectively, of the upper section;

left and right forward portions rigidly coupled with and extending forward from the left and right ends, respectively, of the rear elongated portion; and a forward elongated portion comprising:

a forward subportion substantially parallel to the pivot axis, and left and right forward ends rigidly coupled with the forward subportion and the left and right forward portions.

10. The mobility assistance device of claim 1, wherein the handle further comprises:

a mobile device cradle configured to receive a mobile device.

11. The mobility assistance device of claim 1, wherein the rearward section further comprises:

a kickplate extending in a rearward direction near at least one of the rear wheels and configured to facilitate rotating the device backwards by placing a foot on the kickplate and pulling in a rearward direction on the handle.

12. The mobility assistance device of claim 1, wherein the rear wheels are larger than the front wheels.

13. The mobility assistance device of claim 1, wherein the front wheels are configured to pivot about a vertical axis.

14. A mobility assistance device having a front, a back, a left, and a right, the device comprising:

an upper section comprising:

a substantially horizontal handle extending between a left and a right side of the upper section, wherein the handle is configured for an average size adult person to grasp the handle while standing upright with the person's arms extending forward with elbows at the person's sides, and wherein the handle is located at a height sufficient for the person to rest the person's forearms on the handle when the person's elbows are substantially below the person's shoulders and in front of the person's body;

left and right side rim portions rigidly coupled with the left and right sides, respectively; and a forward rim portion rigidly coupled with the left and right side rim portions and comprising a forward rim subportion substantially parallel to the pivot axis;

a horizontal pivot axis extending through the upper section;

a forward section;

a rearward section;

left and right front wheels rotationally mounted on the forward section;

left and right rear wheels rotationally mounted on the rearward section;

a left pivot joint and a right pivot joint located on the pivot axis, at which left and right sides of the upper section, the forward section, and the rearward section of the device are respectively joined, wherein the upper section, the forward section, and the rearward section are configured to pivot relative to each other at the left and right pivot joints; and an upper basket configured below the handle, coupled with the left side, right side, forward rim portions, and upper section, and extending forward from the upper section, the upper basket further comprising:

a plane configured to be substantially horizontal when the device is in the deployed configuration;

a sidewall comprising a top edge; and a collapsible enclosure comprising an upper enclosure edge and a lower enclosure edge, wherein the lower enclosure edge is coupled with the top edge of the sidewall, wherein the upper enclosure edge is coupled with the left side, right side, and forward rim portions, and wherein the collapsible enclosure is configured to at least partially collapse when the device is in a folded configuration.

15. The mobility assistance device of claim 14, the upper basket further comprising:

at least one projection configured underneath the plane and pivotally coupled along the pivot axis.

* * * * *